US010517448B2

(12) United States Patent
Shiozawa et al.

(10) Patent No.: US 10,517,448 B2
(45) Date of Patent: Dec. 31, 2019

(54) BLOWER APPARATUS AND VACUUM CLEANER

(71) Applicant: Nidec Corporation, Kyoto (JP)

(72) Inventors: Kazuhiko Shiozawa, Kyoto (JP); Ryosuke Hayamitsu, Kyoto (JP); Tomoyoshi Sawada, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 287 days.

(21) Appl. No.: 15/527,049

(22) PCT Filed: Oct. 30, 2015

(86) PCT No.: PCT/JP2015/080698

§ 371 (c)(1),
(2) Date: May 16, 2017

(87) PCT Pub. No.: WO2016/194253

PCT Pub. Date: Dec. 8, 2016

(65) Prior Publication Data

US 2017/0367550 A1 Dec. 28, 2017

Related U.S. Application Data

(60) Provisional application No. 62/168,135, filed on May 29, 2015, provisional application No. 62/168,165,
(Continued)

(51) Int. Cl.

| | |
|---|---|
| ***A47L 5/22*** | (2006.01) |
| ***F04D 29/44*** | (2006.01) |
| ***F04D 29/28*** | (2006.01) |

(52) U.S. Cl.

CPC ..... *A47L 5/22* (2013.01); *F04D 29/44* (2013.01); *F04D 29/281* (2013.01)

(58) Field of Classification Search

CPC ..... A47L 5/22; F04D 29/5806; F04D 29/444; F04D 29/023; F04D 25/06; F04D 29/44;
(Continued)

(56) References Cited

U.S. PATENT DOCUMENTS 3,836,749 A * 9/1974 Hubner ..... A45D 20/18 392/383
6,368,081 B1 * 4/2002 Matsumoto ..... F04D 25/0613 417/423.1
(Continued)

FOREIGN PATENT DOCUMENTS

JP 62-113899 A 5/1987
JP 2000-337295 A 12/2000
(Continued)

OTHER PUBLICATIONS

Hayamitsu, R. et al.; "Blower Apparatus and Vacuum Cleaner"; U.S. Appl. No. 15/522,953, filed Apr. 28, 2017.
(Continued)

*Primary Examiner* — Joseph J Dallo
*Assistant Examiner* — Kurt Philip Liethen
(74) *Attorney, Agent, or Firm* — Keating & Bennett, LLP

(57) ABSTRACT

A blower apparatus according to an exemplary embodiment of the present invention includes a motor including a shaft arranged to extend along a central axis extending in a vertical direction, and a bearing arranged to rotatably support the shaft; an impeller coupled to the shaft on an upper end side of the shaft; an impeller housing arranged to house the impeller, and including an air inlet on an upper side; a plurality of stationary vanes arranged on a lower side of the impeller housing; a cylindrical first ring arranged radially inside of the stationary vanes; and a cylindrical second ring arranged radially outside of the stationary vanes, and fixed to the impeller housing. The stationary vanes, the first ring,
(Continued)

and the second ring are defined by a single monolithic member, and together define at least a portion of a stationary vane support portion.

18 Claims, 27 Drawing Sheets

Related U.S. Application Data filed on May 29, 2015, provisional application No. 62/181,368, filed on Jun. 18, 2015.

(58) Field of Classification Search
CPC . F04D 29/281; F05D 2250/70; F05D 2250/52
See application file for complete search history.

(56) References Cited

U.S. PATENT DOCUMENTS

2005/0163614 A1* 7/2005 Chapman ..... F04D 29/30 415/206
2008/0279681 A1* 11/2008 Eguchi ..... F04D 29/162 415/206
2010/0028147 A1 2/2010 Daguenet et al.
2012/0186036 A1* 7/2012 Kegg ..... A47L 5/22 15/347
2014/0056740 A1 2/2014 Yim et al.
2017/0002830 A1* 1/2017 Bothma ..... F04D 29/667
2018/0172024 A1* 6/2018 Hayamitsu ..... F04D 29/44

FOREIGN PATENT DOCUMENTS

JP 2010-196548 A 9/2010
JP 2010-281231 A 12/2010
JP 2010-281232 A 12/2010
WO 00/06910 A1 2/2000

OTHER PUBLICATIONS

Hayamitsu, R. et al.; "Blower Apparatus and Vacuum Cleaner"; U.S. Appl. No. 15/522,974, filed Apr. 28, 2017.
Sawada, T. et al.; "Centrifugal Blower and Vacuum Cleaner"; U.S. Appl. No. 15/567,087, filed Oct. 17, 2017.
Hayamitsu, R. et al.; "Blower Device and Vacuum Cleaner"; U.S. Appl. No. 15/577,425, filed Nov. 28, 2017.
Hayamitsu, R. et al.; "Blower and Vacuum Cleaner"; U.S. Appl. No. 15/577,421, filed Nov. 28, 2017.
Hayamitsu, R. et al.; "Blower and Vacuum Cleaner"; U.S. Appl. No. 15/576,338, filed Nov. 22, 2017.
Hayamitsu, R. et al.; "Blower and Vacuum Cleaner"; U.S. Appl. No. 15/577,431, filed Nov. 28, 2017.
Sawada, T. et al.; "Blower and Vacuum Cleaner"; U.S. Appl. No. 15/576,311, filed Nov. 22, 2017.

* cited by examiner

BLOWER APPARATUS AND VACUUM CLEANER

BACKGROUND OF THE INVENTION

1. Field of the Invention

The present invention relates to a blower apparatus and a vacuum cleaner.

2. Description of the Related Art

Blower apparatuses to be installed in vacuum cleaners are disclosed in JP-A 2010-281232 and JP-A 2000-337295. In the blower apparatus (i.e., electric blower) disclosed in JP-A 2010-281232, a channel through which exhaust air passes is defined between an outer circumferential surface of a motor case and a tubular air guide arranged to cover the motor case. In this channel, guide vanes (i.e., stationary vanes) each of which extends along a direction in which the exhaust air flows are arranged to control flows of the air and thus achieve improved air exhaust efficiency.

SUMMARY OF THE INVENTION

The aforementioned channel in the blower apparatus described in JP-A 2010-281232 is defined as a result of the tubular air guide being assembled around a motor cover. Therefore, depending on the precision with which the air guide is assembled in relation to the motor cover, the radial width of the channel, extending along a circumferential direction, may vary at different circumferential positions, which might result in unstable pressure and reduced air exhaust efficiency.

A blower apparatus according to an exemplary embodiment of the present invention includes a motor including a shaft arranged to extend along a central axis extending in a vertical direction, and a bearing arranged to rotatably support the shaft; an impeller coupled to the shaft on an upper end side of the shaft; an impeller housing arranged to house the impeller, and including an air inlet on an upper side; a plurality of stationary vanes arranged on a lower side of the impeller housing; a cylindrical first ring arranged radially inside of the stationary vanes; and a cylindrical second ring arranged radially outside of the stationary vanes, and fixed to the impeller housing. The stationary vanes, the first ring, and the second ring are defined by a single monolithic member, and together define at least a portion of a stationary vane support portion.

According to an exemplary embodiment of the present invention, a blower apparatus with a channel having a highly uniform radial width and having improved air exhaust efficiency can be provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, blower apparatuses according to embodiments of the present invention will be described with reference to the accompanying drawings. Note that the scope of the present invention is not limited to the embodiments described below, but includes any modification thereof within the scope of the technical idea of the present invention. Also note that scales, numbers, and so on of members or portions illustrated in the following drawings may differ from those of actual members or portions, for the sake of easier understanding of the members or portions.

In the accompanying drawings, an xyz coordinate system is shown appropriately as a three-dimensional orthogonal coordinate system. In the xyz coordinate system, a z-axis direction is assumed to be a direction parallel to a central axis J shown in FIG. 1. A y-axis direction is assumed to be a direction perpendicular to the z-axis direction, and is assumed to be a left-right direction in FIG. 1. An x-axis direction is assumed to be a direction perpendicular to both the y-axis direction and the z-axis direction.

In addition, it is assumed in the following description that a direction in which the central axis J extends (that is, the z-axis direction) is a vertical direction. A positive side (i.e., a +z side) in the z-axis direction will be referred to as an upper side (or an axially upper side), while a negative side (i.e., a −z side) in the z-axis direction will be referred to as a lower side (or an axially lower side). It should be noted, however, that the above definitions of the vertical direction and the upper and lower sides are made simply for the sake of convenience in description, and are not meant to restrict actual relative positions or directions of different members or portions. In addition, unless otherwise specified, the direction parallel to the central axis J (i.e., the z-axis direction) will be simply referred to by the term "axial direction", "axial", or "axially", radial directions centered on the central axis J will be simply referred to by the term "radial direction", "radial", or "radially", and a circumferential direction about the central axis J will be simply referred to by the term "circumferential direction", "circumferential", or "circumferentially".

Figure 1:
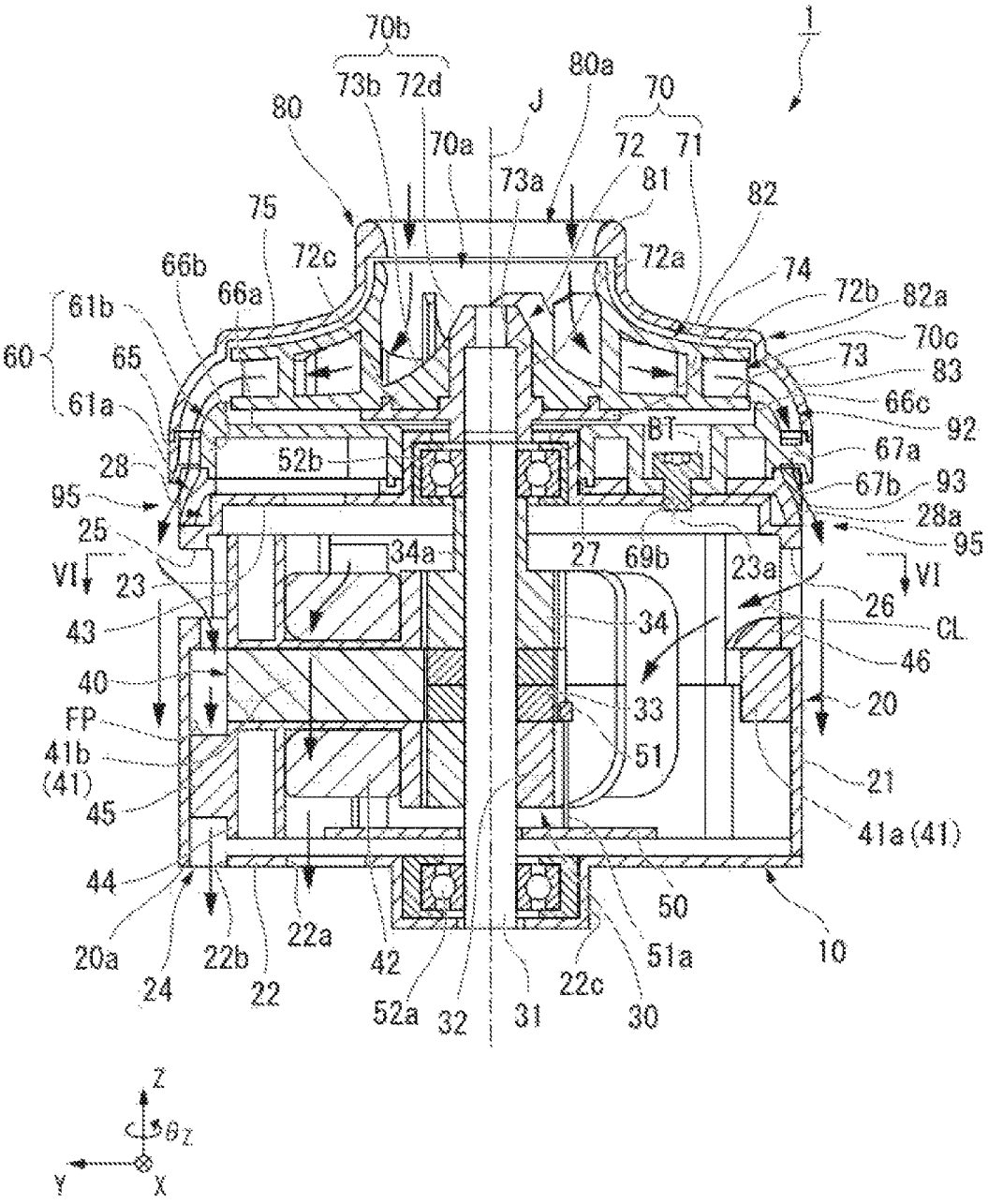
FIG. 1 is a sectional view illustrating a blower apparatus according to an embodiment of the present invention.
Figure 2:
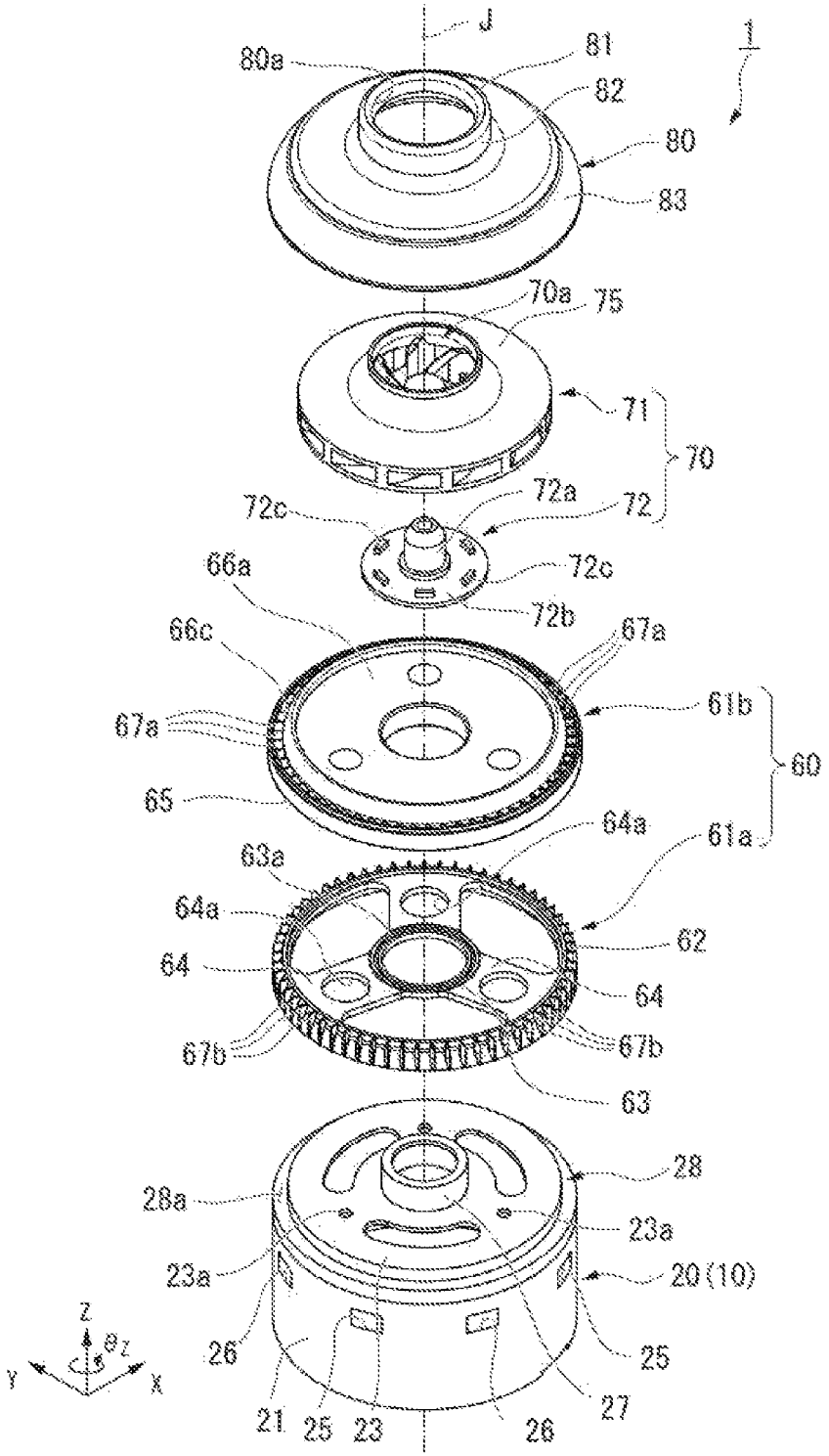
FIG. 2 is an exploded perspective view of the blower apparatus according to an embodiment of the present invention.

FIG. 1 is a sectional view illustrating a blower apparatus 1 according to an embodiment of the present invention. FIG. 2 is an exploded perspective view of the blower apparatus 1 according to the present embodiment.

As illustrated in FIGS. 1 and 2, the blower apparatus 1 includes a motor 10, an impeller 70, an impeller housing 80, a plurality of stationary vanes, a first ring 66*b*, and a second ring 65. The plurality of stationary vanes include upper stationary vanes 67*a* and lower stationary vanes 67*b*, which will be described below.

A stationary vane member 60 is attached on the upper side (i.e., the +z side) of the motor 10. The impeller housing 80 is attached on the upper side of the stationary vane member 60. The impeller 70 is housed in a space between the stationary vane member 60 and the impeller housing 80. The impeller 70 is attached to the motor 10 such that the impeller 70 is rotatable about the central axis J.

[Motor]

Figure 3:
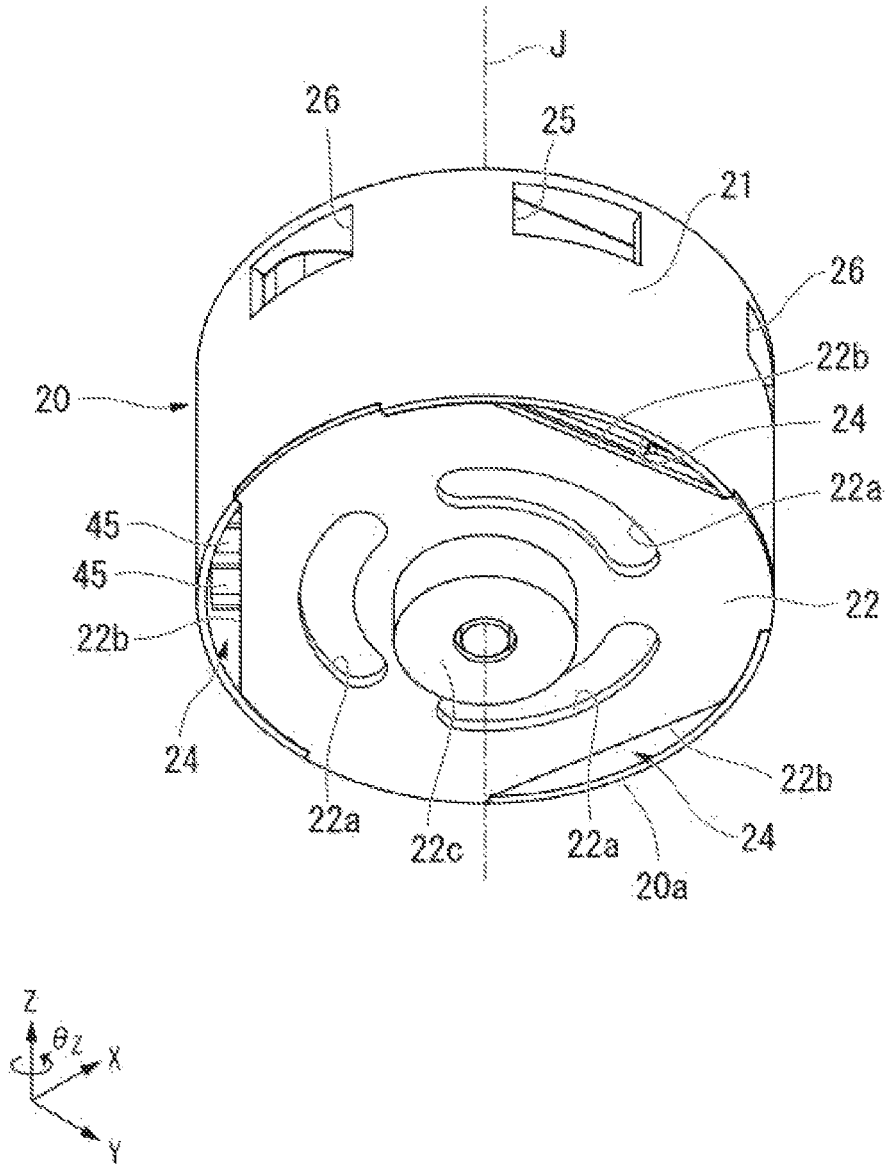
FIG. 3 is a perspective view of a motor according to an embodiment of the present invention as viewed from below.

FIG. 3 is a perspective view of the motor according to the present embodiment as viewed from below.

As illustrated in FIG. 1, the motor 10 includes a housing 20, a lower lid 22, a rotor 30 including a shaft 31, a stator 40, a circuit board 50, a lower-side bearing 52*a*, and an upper-side bearing 52*b*. That is, the motor 10 further includes the housing 20. In more detail, the motor 10 includes the shaft 31, which is arranged to extend along the central axis J extending in the vertical direction, and the bearings 52*a* and 52*b*, each of which is arranged to rotatably support the shaft 31.

The housing 20 is a cylindrical container having a lid and arranged to house the rotor 30 and the stator 40. The housing 20 is arranged to surround the stator 40 from radially outside. The housing 20 includes a cylindrical circumferential wall 21, an upper lid portion 23 arranged at an upper end of the circumferential wall 21, and an upper-side bearing holding portion 27 arranged at a central portion of the upper lid portion 23. The stator 40 is fixed to an inside surface of the housing 20. The upper-side bearing holding portion 27 is tubular, and is arranged to project upward from the central portion of the upper lid portion 23. The upper-side bearing holding portion 27 is arranged to hold the upper-side bearing 52*b* therein.

As illustrated in FIGS. 1 and 3, an upper portion of the circumferential wall of the housing 20 includes through holes 25 and 26 each of which is arranged to pass through the housing 20 in a radial direction. In the circumferential wall of the housing 20, the through holes 25, which are arranged at three positions, and the through holes 26, which are also arranged at three positions, are arranged alternately around the axis (see FIG. 6). This structure enables portions of air which is discharged through an air outlet 95, which will be described below, to flow into the housing 20 to cool a stator core 41 and coils 42. A shoulder portion 28, which is arranged to surround the upper lid portion 23 around the axis, is defined between the upper lid portion 23 and the circumferential wall 21 of the housing 20.

The lower lid 22 is attached to an opening portion on the lower side (i.e., the −z side) of the housing 20. A tubular lower-side bearing holding portion 22*c*, which is arranged to project downward from a lower surface of the lower lid 22, is arranged at a central portion of the lower lid 22. The lower-side bearing holding portion 22*c* is arranged to hold the lower-side bearing 52*a*.

As illustrated in FIG. 3, the lower lid 22 includes three through holes 22*a*, each of which is in the shape of a circular arc and has a radial width, at three positions around the axis. Three cut portions 22*b*, each of which is defined by cutting an outer circumferential portion of the lower lid 22 in a straight manner, are defined at an outer circumferential end of the lower lid 22. A gap between each cut portion 22*b* and an opening end 20*a* on the lower side of the housing 20 defines a lower-side opening portion 24 of the motor 10.

As illustrated in FIG. 1, the rotor 30 includes the shaft 31, a rotor magnet 33, a lower-side magnet fixing member 32, and an upper-side magnet fixing member 34. The rotor magnet 33 is cylindrical, and is arranged to surround the shaft 31 from radially outside, extending around the axis (i.e., in a θz direction). Each of the lower-side magnet fixing member 32 and the upper-side magnet fixing member 34 is cylindrical and has a diameter equivalent to that of the rotor magnet 33. The lower-side magnet fixing member 32 and the upper-side magnet fixing member 34 are attached to the shaft 31 with the rotor magnet 33 being held thereby from both axial sides. The upper-side magnet fixing member 34 includes, on the upper side in the direction parallel to the central axis, a decreased diameter portion 34*a* having a diameter smaller than that of a portion thereof on the lower side (i.e., the side closer to the rotor magnet 33).

The shaft 31 is arranged to extend along the central axis J. The shaft 31 is supported by the lower-side bearing 52*a* and the upper-side bearing 52*b* to be rotatable about the axis (i.e., in the θz direction). The impeller 70 is coupled to the shaft 31 on an upper end side of the shaft 31. The impeller 70 is arranged to rotate about the axis together with the shaft 31.

Figure 4:
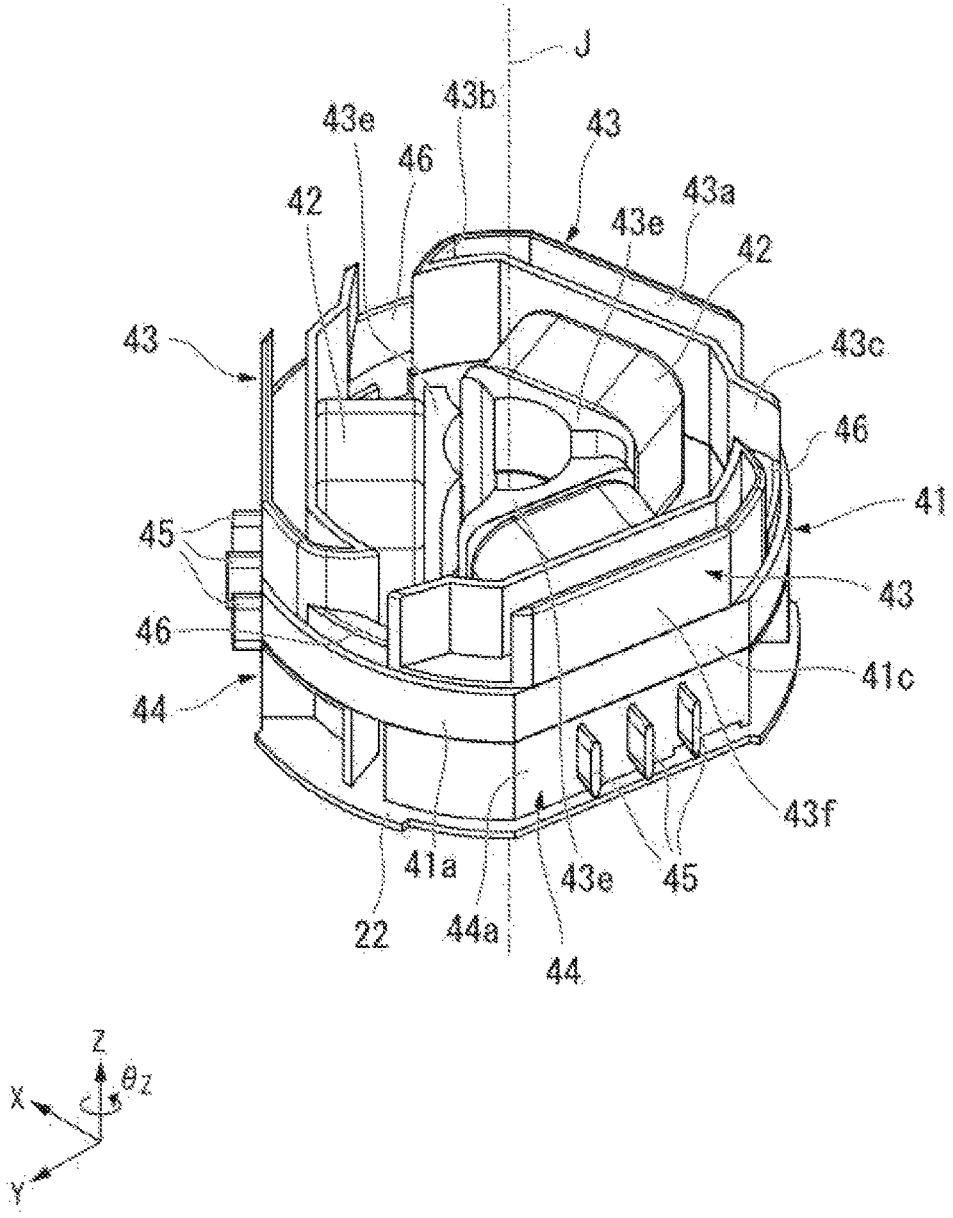
FIG. 4 is a perspective view of a stator according to an embodiment of the present invention.
Figure 5:
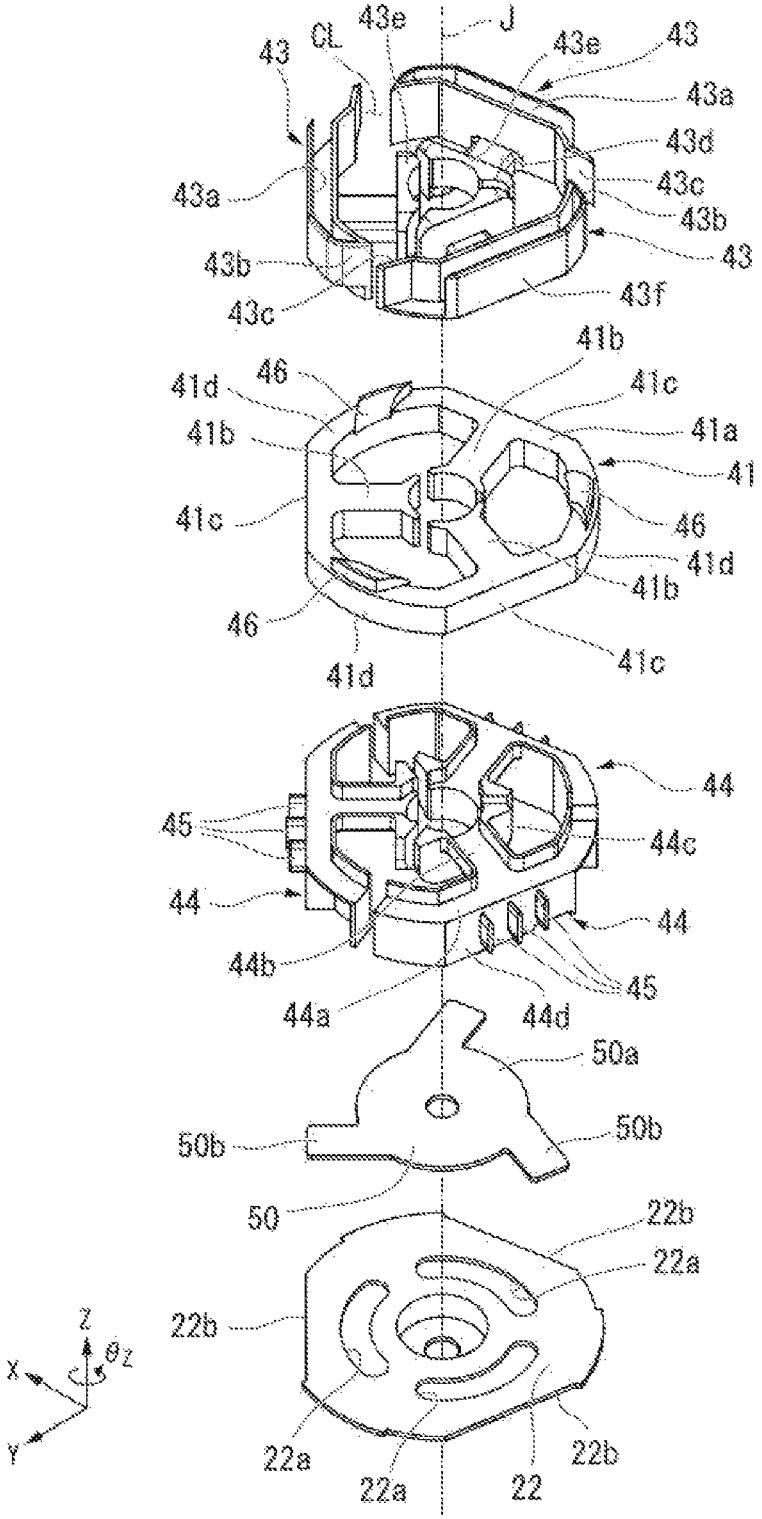
FIG. 5 is an exploded perspective view illustrating the stator, a circuit board, and a lower lid according to an embodiment of the present invention.
Figure 6:
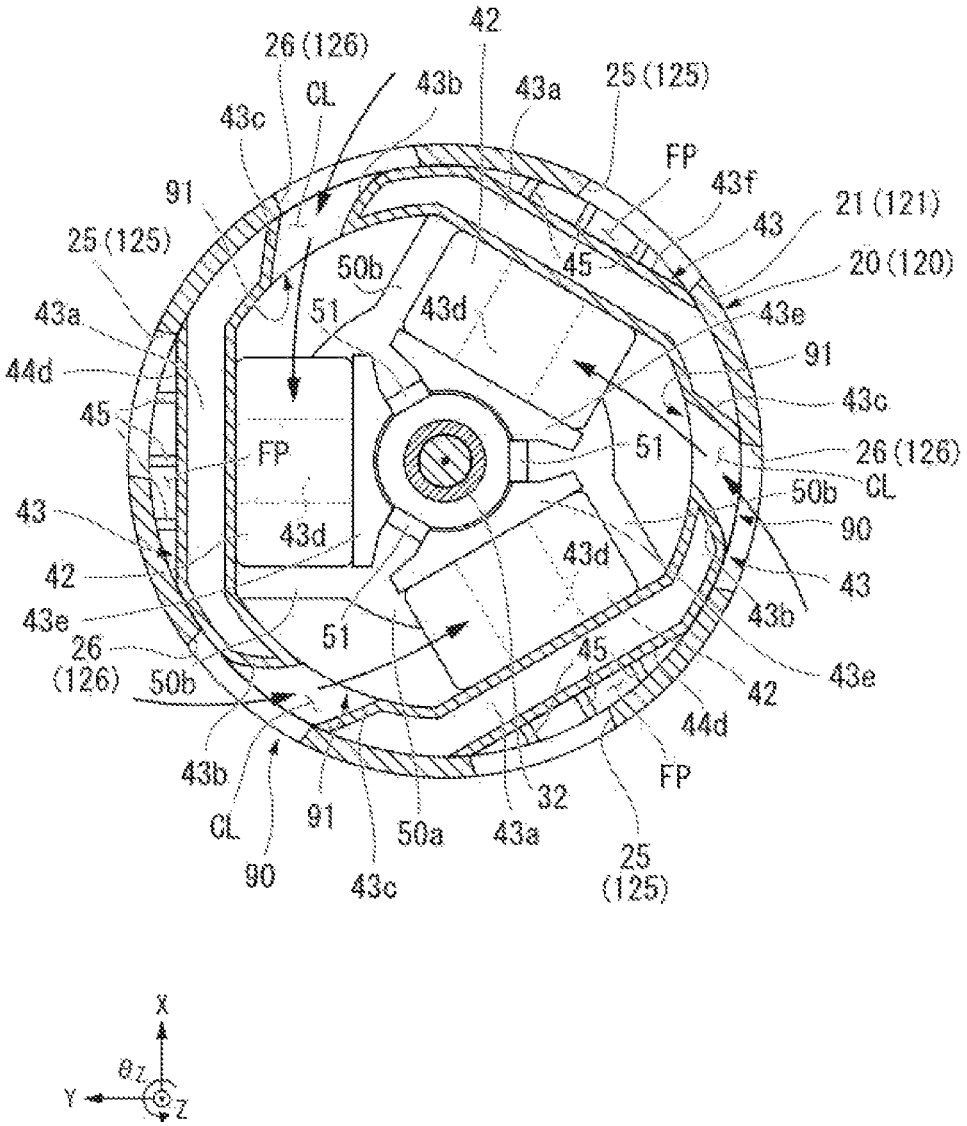
FIG. 6 is a sectional plan view of the motor.

FIG. 4 is a perspective view of the stator according to the present embodiment. FIG. 5 is an exploded perspective view illustrating the stator 40, the circuit board 50, and the lower lid 22. FIG. 6 is a sectional plan view of the motor 10.

The stator 40 is arranged radially outside of the rotor 30. The stator 40 is arranged to surround the rotor 30, extending around the axis (i.e., in the θz direction). As illustrated in FIGS. 4 and 5, the stator 40 includes the stator core 41, a plurality of (three) upper-side insulators 43, a plurality of (three) lower-side insulators 44, and the coils 42.

As illustrated in FIG. 5, the stator core 41 includes a core back portion 41*a* and a plurality of (three) tooth portions 41*b*. The core back portion 41*a* is in the shape of a ring, and is arranged to extend around the central axis. The core back portion 41*a* includes three straight portions 41*c* and three circular arc portions 41*d* arranged to alternate with each other around the axis. Each of the tooth portions 41*b* is arranged to extend radially inward from an inner circumferential surface of a separate one of the straight portions 41*c*. The tooth portions 41*b* are arranged at regular intervals in the circumferential direction. A slanting member 46, which is arranged to guide exhaust air into the stator 40, is arranged on an upper surface of each circular arc portion 41*d* of the core back portion 41*a*. The slanting member 46 is arranged to decrease in thickness as it extends radially inward from a radially outer side.

Each upper-side insulator 43 is an insulating member arranged to cover portions of an upper surface and a side surface of the stator core 41. Each upper-side insulator 43 is arranged for a separate one of the three tooth portions 41*b*. Each upper-side insulator 43 includes an upper-side outer circumferential wall portion 43*a* arranged on the upper side of the core back portion 41*a*, an upper-side inner circumferential wall portion 43*e* arranged on the upper side of a tip of the corresponding tooth portion 41*b*, and an upper-side insulating portion 43*d* arranged to extend in a radial direction to join the upper-side outer circumferential wall portion 43*a* and the upper-side inner circumferential wall portion 43*e* to each other on the upper side of a portion of the corresponding tooth portion 41*b* around which the coil is wound.

Each lower-side insulator 44 is an insulating member arranged to cover portions of a lower surface and the side surface of the stator core 41. Each lower-side insulator 44 is arranged for a separate one of the three tooth portions 41*b*. Each lower-side insulator 44 includes a lower-side outer circumferential wall portion 44*a* arranged on the lower side of the core back portion 41*a*, a lower-side inner circumferential wall portion 44*c* arranged on the lower side of the tip of the corresponding tooth portion 41*b*, and a lower-side insulating portion 44*b* arranged to extend in a radial direction to join the lower-side outer circumferential wall portion 44*a* and the lower-side inner circumferential wall portion 44*c* to each other on the lower side of the portion of the corresponding tooth portion 41*b* around which the coil is wound.

The upper-side insulators 43 and the lower-side insulators 44 are arranged to hold the tooth portions 41*b* of the stator core 41 therebetween in the vertical direction. The coils 42 are wound around the tooth portions 41*b*, which are covered with the upper-side insulating portions 43*d* of the upper-side insulators 43 and the lower-side insulating portions 44*b* of the lower-side insulators 44.

The three upper-side outer circumferential wall portions 43*a*, which are arranged on the core back portion 41*a* of the stator core 41, are arranged to surround the coils 42 on the upper side of the stator core 41. Each upper-side outer circumferential wall portion 43*a* includes a first side end surface 43*b* and a second side end surface 43*c* at both circumferential ends thereof. The first side end surface 43*b* is a slanting surface angled with respect to the radial direction to face radially outward. The second side end surface 43*c* is a slanting surface angled with respect to the radial direction to face radially inward. A portion of an outer circumferential surface of the upper-side outer circumferential wall portion 43*a* which is located over the straight portion 41*c* defines a flat surface 43*f* arranged to extend in an axial direction in alignment with an outer circumferential surface of the straight portion 41*c*. A surface in the shape of a circular arc and arranged to extend along an inner circumferential surface of the housing 20 is arranged on either circumferential side of the flat surface 43*f*.

As illustrated in FIG. 6, circumferentially adjacent ones of the upper-side outer circumferential wall portions 43*a* are spaced from each other by a predetermined distance. The first side end surface 43*b* of one of the adjacent upper-side outer circumferential wall portions 43*a* and the second side end surface 43*c* of another one of the adjacent upper-side outer circumferential wall portions 43*a* are arranged circumferentially opposite to each other. The degree to which the first side end surface 43*b* is angled with respect to the radial direction is different from the degree to which the second side end surface 43*c* is angled with respect to the radial direction. In more detail, a circumferential width of a radially outer opening portion 90 of a gap CL defined between the adjacent upper-side outer circumferential wall portions 43*a* is greater than a circumferential width of a radially inner opening portion 91 of the gap CL.

The slanting member 46, which is arranged on the core back portion 41*a*, is arranged under the gap CL. The slanting member 46 is arranged between the first side end surface 43*b* and the second side end surface 43*c*. The gap CL is arranged inside of each through hole 26 of the housing 20. The through hole 26 and the gap CL together define an air channel through which exhaust air flowing into the housing 20 from outside is guided into the stator 40. A direction toward which the gap CL is angled with respect to the radial direction (leading from the radial outside to the radial inside) in a plan view coincides with a direction toward which exhaust air discharged from the stationary vane member 60 flows in the circumferential direction, that is, coincides with a rotation direction of the impeller 70.

As illustrated in FIG. 6, since the opening portion 90 of the gap CL on the entrance side is relatively large, more exhaust air can be sucked in through the through hole 26, and since the width of the opening portion 91 on the exit side is relatively small, air to be discharged from the gap CL can be caused to flow more accurately toward a target position (an adjacent one of the coils 42). Accordingly, the stator core 41 and the coils 42 can be more efficiently cooled by air flowing in through each through hole 26.

The three lower-side outer circumferential wall portions 44*a*, which are arranged on the lower side of the core back portion 41*a*, are arranged to surround the coils 42 on the lower side of the stator core 41. Circumferentially adjacent ones of the lower-side outer circumferential wall portions 44*a* are spaced from each other, but the adjacent lower-side outer circumferential wall portions 44*a* may alternatively be arranged to be in contact with each other in the circumferential direction. A portion of an outer circumferential surface of each lower-side outer circumferential wall portion 44*a* which is located under the corresponding straight portion 41*c* of the core back portion 41*a* defines a flat surface 44*d* arranged to extend in the axial direction in alignment with the outer circumferential surface of the straight portion 41*c*. A surface in the shape of a circular arc and arranged to extend along the inner circumferential surface of the housing 20 is arranged on either circumferential side of the flat surface 44*d*.

A plurality of (three in the illustrated example) plate-shaped portions 45, each of which extends in the axial direction, are arranged on the flat surface 44*d*. As illustrated in FIG. 6, each plate-shaped portion 45 is arranged to extend substantially perpendicularly to the flat surface 44*d*. A radially outer end of the plate-shaped portion 45 is arranged to reach the inner circumferential surface of the housing 20. The plate-shaped portions 45 divide a region between the lower-side outer circumferential wall portion 44*a* and the housing 20 into a plurality of regions in the circumferential direction.

As illustrated in FIGS. 1 and 6, the circuit board 50 is arranged between the stator 40 and the lower lid 22. The circuit board 50 includes a body portion 50*a* in the shape of a circular ring, and three projecting portions 50*b* each of which is arranged to project outward from an outer circumferential edge of the body portion 50*a* obliquely with respect to a radial direction. The body portion 50*a* includes a through hole through which the shaft 31 is arranged to pass. The circuit board 50 is fixed to the lower-side insulators 44.

As illustrated in FIG. 6, three rotation sensors 51 at least are mounted on the circuit board 50. Each rotation sensor 51 is, for example, a Hall element. The circuit board 50 may be electrically connected to the coils 42. In this case, a drive circuit to output drive signals to the coils 42 may be mounted on the circuit board 50.

Figure 7:
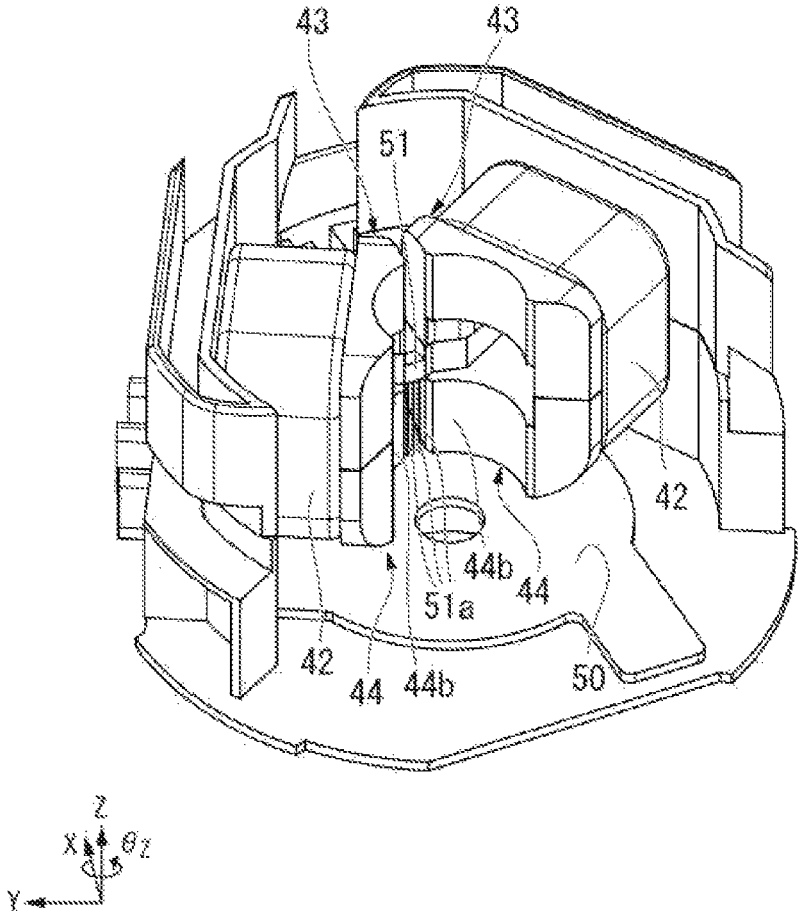
FIG. 7 is an explanatory diagram illustrating a manner in which rotation sensors are mounted according to an embodiment of the present invention.

FIG. 7 is an explanatory diagram illustrating a manner in which each rotation sensor 51 is mounted thereon.

As illustrated in FIGS. 6 and 7, each rotation sensor 51 is arranged to be held between tip portions of circumferentially adjacent ones of the lower-side inner circumferential wall portions 44*c*. The three rotation sensors 51 are arranged at regular intervals of 120 degrees in the circumferential direction. A radially inner surface of each rotation sensor 51 is arranged opposite to the rotor magnet 33. In the present embodiment, the rotor magnet 33 is arranged in an axial middle portion of the rotor 30. Accordingly, each rotation sensor 51 is connected to the circuit board 50 through leads 51*a* each of which has a length corresponding to an axial distance between the circuit board 50 and the rotor magnet 33. Arranging each of the three rotation sensors 51 to be held between the tip portions of the circumferentially adjacent ones of the lower-side inner circumferential wall portions 44*c* allows a reduction in the axial dimension of the motor 10 compared to, for example, a case where a sensor magnet is arranged below the lower-side magnet fixing member 32, and the rotation sensors 51 are arranged below the sensor magnet.

The tip portions of the lower-side inner circumferential wall portions 44*c* may be provided with mechanisms to support the rotation sensors 51. For example, recessed portions in which the rotation sensors 51 are inserted may be provided to restrain the rotation sensors 51 from radial movement. Alternatively, the rotation sensors 51 may be fixed to the lower-side inner circumferential wall portions 44*c* through, for example, snap fitting.

The lower lid 22 is attached to the opening end 20*a* of the housing 20, in which the stator 40 and the circuit board 50 are housed. As illustrated in FIG. 1, at least a portion of each of the three through holes 22*a* of the lower lid 22 is arranged radially outward of an outer circumferential end of the body portion 50*a* of the circuit board 50.

The cut portions 22*b* at an outer periphery of the lower lid 22 are arranged to substantially coincide with the straight portions 41*c* of the stator core 41, the flat surfaces 43*f* of the upper-side insulators 43, and the flat surfaces 44*d* of the lower-side insulators 44 when viewed in the axial direction. The lower-side opening portion 24 at a lower surface of the motor 10 defines an air outlet for an air channel FP between the stator 40 and the housing 20.

[Stationary Vane Member, Impeller, and Impeller Housing]

Next, the stationary vane member, the impeller, and the impeller housing will now be described below.

Figure 8:
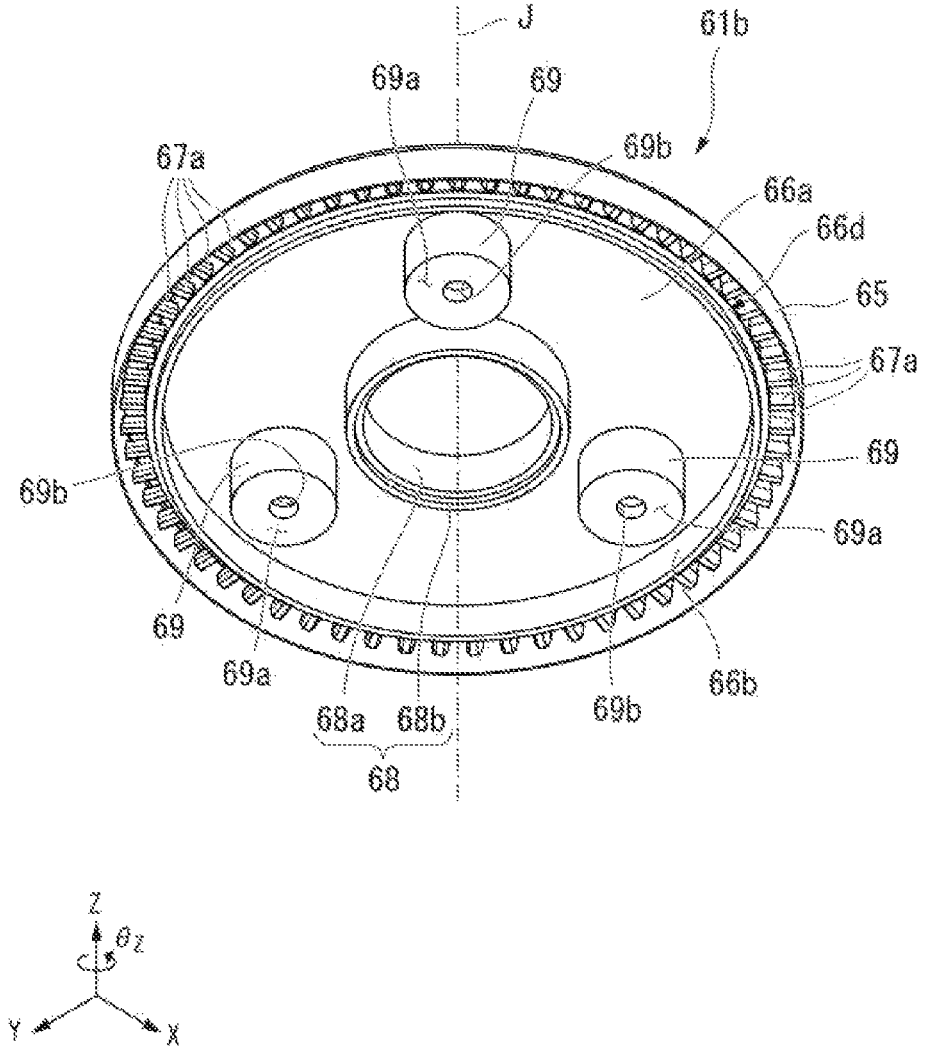
FIG. 8 is a perspective view of a stationary vane member according to an embodiment of the present invention as viewed from below.
Figure 9:
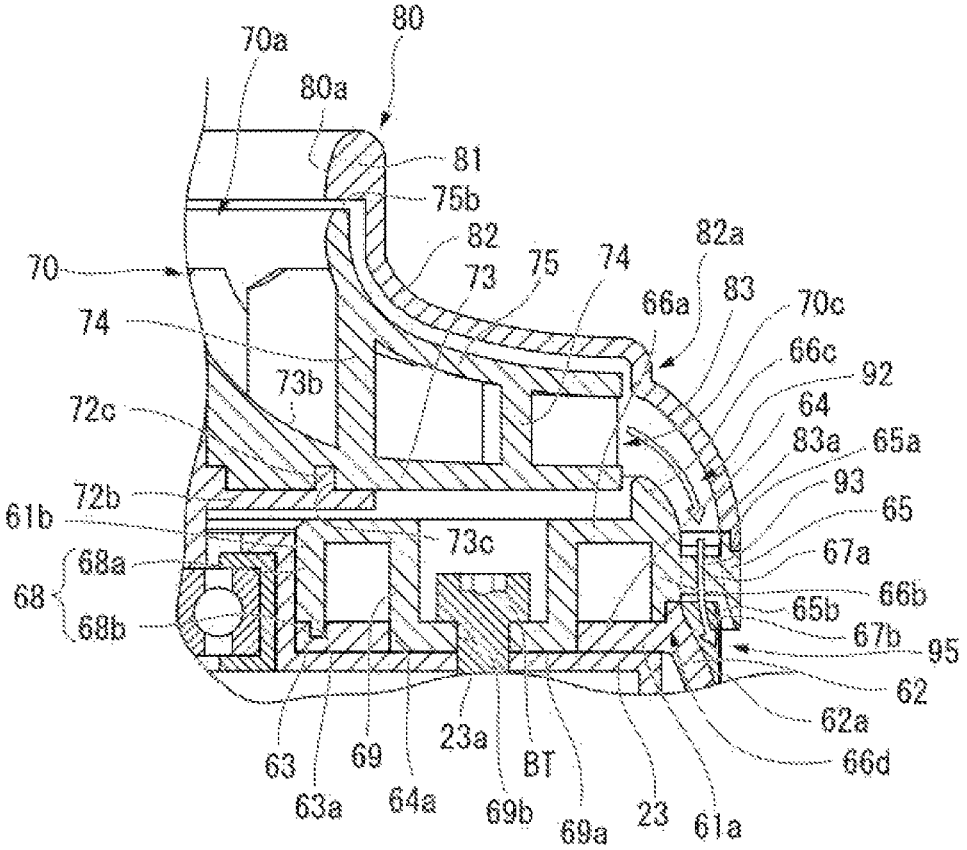
FIG. 9 is a sectional view illustrating portions of an impeller, the stationary vane member, and an impeller housing according to an embodiment of the present invention in an enlarged form.

FIG. 8 is a perspective view of the stationary vane member as viewed from below. FIG. 9 is a sectional view illustrating portions of the impeller 70, a first stationary vane member 61*a*, a second stationary vane member 61*b*, and the impeller housing 80 in an enlarged form.

<Stationary Vane Member>

As illustrated in FIGS. 1 and 2, the stationary vane member 60 includes the first stationary vane member 61*a* and the second stationary vane member (i.e., a stationary vane support portion) 61*b*. The first stationary vane member 61*a* and the second stationary vane member 61*b* are arranged one upon the other in the axial direction, and are attached to an upper surface of the motor 10.

The blower apparatus 1 further includes a lower stationary vane support ring 62. The first stationary vane member 61*a* includes the lower stationary vane support ring (i.e., a third ring) 62, a fitting ring 63, three joining portions 64, and the lower stationary vanes 67*b*. The lower stationary vane support ring 62 and the fitting ring 63 are arranged to be coaxial with each other, and are joined to each other through the three joining portions 64, each of which extends in a radial direction. The three joining portions 64 are arranged at regular intervals of 120 degrees in the circumferential direction. Each joining portion 64 includes a through hole 64*a* arranged to pass therethrough in the axial direction. The three through holes 64*a* are arranged at regular intervals of 120 degrees in the circumferential direction. The fitting ring 63 includes a recessed groove 63*a* concentric with the fitting ring 63 in an upper surface thereof.

Note that, in the present embodiment, the second stationary vane member 61*b* corresponds to the "stationary vane support portion". Also note that the lower stationary vane support ring 62 corresponds to the "third ring".

The lower stationary vane support ring 62 is arranged to have a cylindrical shape or a substantially cylindrical shape, and is arranged on the lower side of the upper stationary vanes 67*a* provided in the second stationary vane member 61*b*. That is, the blower apparatus 1 further includes the third ring, which is arranged on the lower side of the stationary vanes. As illustrated in FIG. 9, the lower stationary vane support ring 62 includes a slanting portion (i.e., a third ring slanting portion) 62*a* having an outer circumference arranged to extend radially outward with decreasing height. Accordingly, the exhaust air can be guided radially outward.

Each of the lower stationary vanes 67*b* is arranged to project radially outward from an outer circumferential surface of the lower stationary vane support ring 62. That is, the lower stationary vane support ring 62 further includes the lower stationary vanes 67*b*, which are arranged on the lower side of the upper stationary vanes 67*a*. This reduces the likelihood of an occurrence of turbulence in exhaust air flowing between the lower stationary vanes 67*b*, leading to improved air blowing efficiency in a channel. The lower stationary vanes 67*b* are arranged at regular intervals in the circumferential direction. The outer circumferential surface of the lower stationary vane support ring 62 is arranged to have a tapered shape with the diameter thereof decreasing with increasing height. Each lower stationary vane 67*b* is arranged to increase in radial width with increasing height. The plurality of stationary vanes (i.e., the upper stationary vanes 67*a* and the lower stationary vanes 67*b*) are arranged on the lower side of the impeller housing 80.

The second stationary vane member 61*b* includes a support body 66*a* in the shape of a ring disk, an upper stationary vane support ring (i.e., the first ring) 66*b* being cylindrical and arranged to extend downward from an outer circumferential edge of the support body 66*a*, the upper stationary vanes 67*a*, an outer circumferential ring (i.e., the second ring) 65 being cylindrical and connected to radially outer sides of the upper stationary vanes (i.e., stationary vanes) 67*a*, and an annular projecting portion 66*c* arranged to project upward from the outer circumferential edge of the support body 66*a*. That is, the blower apparatus 1 includes the upper stationary vanes 67*a*, the upper stationary vane support ring 66*b*, and the outer circumferential ring 65.

Each of the upper stationary vane support ring 66*b* and the outer circumferential ring 65 may be arranged to have a substantially cylindrical shape. The term "substantially cylindrical shape" includes shapes equivalent to the shape of a cylinder, including, for example, the shape of a cylinder with an uneven inner circumferential surface and an uneven outer circumferential surface, and a substantially cylindrical shape having an elliptical cross section.

The upper stationary vane support ring 66*b* is arranged radially inside of the upper stationary vanes 67*a*. As illustrated in FIG. 9, a lower end portion of the upper stationary vane support ring 66*b* includes a shoulder portion 66*d* arranged to extend over the entire circumferential extent thereof on the radially outer side.

The outer circumferential ring 65 is arranged radially outside of the upper stationary vanes 67*a*. As illustrated in FIG. 9, an upper end portion of the outer circumferential ring 65 includes a shoulder portion 65*a* arranged to extend over the entire circumferential extent thereof on the radially outer side.

The upper stationary vanes 67*a* are arranged on the lower side of the impeller housing 80. In addition, each of the upper stationary vanes 67*a* is arranged to extend in a radial direction to join an outer circumferential surface of the upper stationary vane support ring 66*b* and an inner circumferential surface of the outer circumferential ring 65 to each other. That is, the upper stationary vanes 67*a*, the upper stationary vane support ring 66*b*, and the outer circumferential ring 65 are defined by a single monolithic member, and together define a portion of the second stationary vane member 61*b*. This contributes to increasing coaxiality of the motor 10, the second stationary vane member 61*b*, and the outer circumferential ring 65. Further, a channel defined on the radially outer side of the upper stationary vane support ring 66*b* in the second stationary vane member 61*b* is thus arranged to be symmetric with respect to the central axis J of the motor 10, resulting in increased stability of pressure in the channel.

Note that, in the present embodiment, the upper stationary vane support ring 66*b* corresponds to the "first ring", and the outer circumferential ring 65 corresponds to the "second ring".

As illustrated in FIG. 8, the support body 66*a* includes a fitting ring 68 arranged to extend downward from a lower surface of a central portion thereof, and three columnar projection portions 69 each of which is arranged to project downward from a lower surface of the support body 66*a*. The fitting ring 68 includes a tubular portion 68*a* being cylindrical, and a projecting portion 68*b* being annular and arranged to project downward from a radially outer circumferential portion of a lower end surface of the tubular portion 68*a*. The three columnar projection portions 69 are arranged to have equivalent diameters and heights, and are arranged at regular intervals of 120 degrees in the circumferential direction. In the present embodiment, each columnar projection portion 69 is hollow, and includes a through hole 69*b* arranged to pass therethrough in the axial direction in a center of a lower end surface 69*a* thereof.

Note that, in the present embodiment, each columnar projection portion 69 corresponds to a "second fixing portion". That is, the second stationary vane member 61*b* includes the columnar projection portions (i.e., the second fixing portions) 69.

As illustrated in FIGS. 1 and 9, the upper-side bearing holding portion 27 of the motor 10 is inserted in the fitting ring 63 of the first stationary vane member 61*a*. A lower end surface of the lower stationary vane support ring 62 of the first stationary vane member 61*a* is arranged to be in contact with a shoulder surface 28*a*, which faces upward, of the shoulder portion 28 of the motor 10.

The second stationary vane member 61*b* is attached to the first stationary vane member 61*a*. As illustrated in FIG. 9, the upper-side bearing holding portion 27 is inserted in the fitting ring 68 of the second stationary vane member 61*b*. The projecting portion 68*b* at a lower end of the fitting ring 68 is fitted into the recessed groove 63*a* of the first stationary vane member 61*a*. The shoulder portion 66*d* of the upper stationary vane support ring 66*b* of the second stationary vane member 61*b* is fitted to an upper opening end of the lower stationary vane support ring 62. The outer circumferential surface of the upper stationary vane support ring 66*b* and the outer circumferential surface of the lower stationary vane support ring 62 are smoothly joined to each other in the vertical direction.

The columnar projection portions 69 of the second stationary vane member 61*b* are inserted into the through holes 64*a* of the first stationary vane member 61*a*. The end surface 69*a* of each columnar projection portion 69 is arranged to be in contact with an upper surface of the upper lid portion 23 of the motor 10. A bolt BT is inserted through the through hole 69*b* of each columnar projection portion 69 and a corresponding screw hole 23*a* of the upper lid portion 23 to fasten the second stationary vane member 61*b* to the motor 10. At least a portion of the second stationary vane member 61*b* is fixed to the housing 20. Specifically, each columnar projection portion 69 is fixed to the housing 20. Thus, at least a portion of the second stationary vane member 61*b* is fixed to the housing 20 through the columnar projection portions 69 of the support body 66*a*. The first stationary vane member 61*a* is circumferentially positioned by the columnar projection portions 69 of the second stationary vane member 61*b*, and is fixed to the motor 10 by being held by the upper stationary vane support ring 66*b* and the fitting ring 68 of the second stationary vane member 61*b*. Thus, the second stationary vane member 61*b* is arranged to fix the first stationary vane member 61*a* with the fitting ring 68 and the upper stationary vane support ring 66*b*. That is, the fitting ring 68 and the upper stationary vane support ring 66*b* serve as fixing portions (i.e., first fixing portions) to fix the first stationary vane member 61*a*. In addition, these fixing portions fix the lower stationary vane support ring (i.e., the third ring) 62, which is a portion of the first stationary vane member 61*a*, by fixing the first stationary vane member 61*a*. That is, the second stationary vane member 61*b* includes the first fixing portions, to which the lower stationary vane support ring 62 is fixed.

Because the second stationary vane member 61*b* according to the present embodiment is fixed to the housing 20 of the motor 10, it is easy to increase the coaxiality of the motor 10 and the second stationary vane member 61*b*. The channel defined on the radially outer side of the upper stationary vane support ring 66*b* in the second stationary vane member 61*b* is thus arranged to be symmetric with respect to the central axis J of the motor 10, resulting in increased stability of the pressure in the channel.

In the present embodiment, the stationary vane member 60 is defined by two members (i.e., the first stationary vane member 61*a* and the second stationary vane member 61*b*), while only the second stationary vane member 61*b* is fastened to the housing 20, which is made of a metal, of the motor 10. In addition, the second stationary vane member 61*b* is fixed to the housing 20 at positions different from those of the first fixing portions (i.e., the fitting ring 68 and the upper stationary vane support ring 66*b*) arranged to fix the first stationary vane member 61*a*. Specifically, the second stationary vane member 61*b* includes the columnar projection portions 69, each of which is fixed to the housing 20 at a position different from the positions of the first fixing portions. The above manner of fixing contributes to preventing a change in the temperature of the blower apparatus 1 from causing a problem in the fastening between the motor 10 and the stationary vane member 60.

To explain specifically, if both the first stationary vane member 61*a* and the second stationary vane member 61*b* were fixed to the motor 10 with common bolts BT inserted therethrough, resulting in each bolt BT fastening the two resin members, a volume change thereof caused by a change in the temperature would be greater. Therefore, a low-temperature environment might cause the stationary vane member 60 to contract and become loose. In contrast, in the present embodiment, the end surface 69*a* of each columnar projection portion 69 of the second stationary vane member 61*b* is arranged to be in contact with the housing 20, and is fastened thereto with the bolt BT, and therefore, the thickness of a resin member fixed with the bolt BT can be reduced. This will result in a reduction in the volume change caused by the change in the temperature, which reduces the likelihood that the fastening will become loose.

Figure 10:
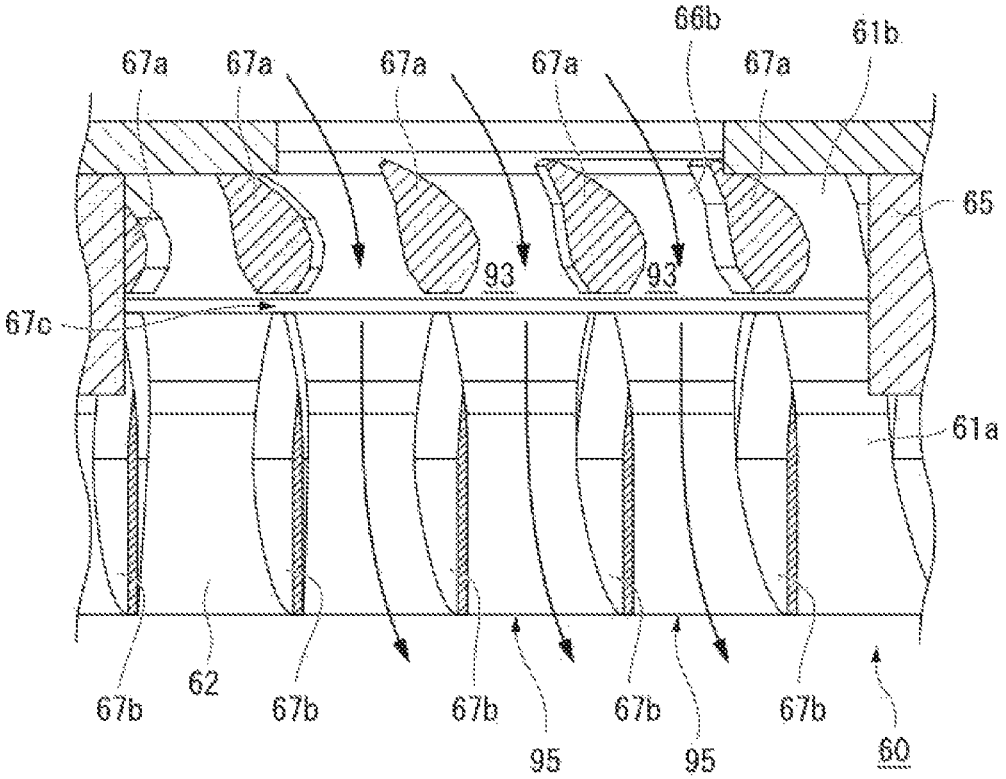
FIG. 10 is a partial side view of the stationary vane member.

FIG. 10 is a partial side view of the stationary vane member 60.

As illustrated in FIG. 10, the upper stationary vanes 67*a* and the lower stationary vanes 67*b*, both of which are arranged in the circumferential direction, are the same in number. Each of the upper stationary vanes 67*a* is paired with a separate one of the lower stationary vanes 67*b*, and the upper and lower stationary vanes 67*a* and 67*b* in the same pair are arranged one above the other in the axial direction. In the present embodiment, an angle of inclination of each upper stationary vane 67*a* with respect to the axial direction is arranged to be greater than an angle of inclination of each lower stationary vane 67*b* with respect to the axial direction. Each upper stationary vane 67*a* is arranged to be angled at a relatively large angle to allow exhaust air flowing in a direction angled toward the rotation direction of the impeller 70 to efficiently flow into spaces between the upper stationary vanes 67*a*. Each lower stationary vane 67*b* is arranged to guide the exhaust air downward to prevent the exhaust air from flowing radially outward after being discharged through the air outlet 95.

In the present embodiment, a gap 67*c* is a gap extending in a horizontal direction, but may alternatively be a gap extending in a direction at an angle to the horizontal direction. In the case where the gap 67*c* is arranged to be a gap extending in a direction at an angle to the horizontal direction, the gap 67*c* is preferably arranged to be angled in the same direction as each upper stationary vane 67*a*. Provision of the gap angled in such a direction allows the exhaust air to pass in the gap to allow an effective use of an entire exhaust air channel 93.

In the present embodiment, the lower stationary vane support ring 62 includes the slanting portion (i.e., the third ring slanting portion) 62*a* as illustrated in FIG. 9, and therefore, the exhaust air channel 93 shifts radially outward in the vicinity of the air outlet 95. That is, the outer circumferential surface of the lower stationary vane support ring 62 of the first stationary vane member 61*a* is arranged to have a tapered shape with the diameter thereof increasing with decreasing height, and includes the slanting portion 62*a*. In addition, the outer circumferential ring 65 of the second stationary vane member 61*b* includes a lower ring 65*b* arranged radially opposite to the lower stationary vane support ring 62, and the lower ring 65*b* has a skirt-like shape with the inside diameter thereof increasing with decreasing height. With the above arrangement, the exhaust air channel 93 shifts radially outward with decreasing height with a constant radial width. As a result, the horizontal cross-sectional area of the exhaust air channel 93 gradually increases with decreasing distance from the air outlet 95. This contributes to reducing exhaust noise that occurs when the air is discharged through the air outlet 95.

<Impeller>

The impeller 70 is coupled to the shaft 31 on the upper end side of the shaft 31. The impeller 70 is arranged to discharge a fluid sucked in through an air inlet 70*a* which opens upward radially outward through an internal channel. The impeller 70 includes an impeller body 71 and an impeller hub 72.

The impeller body 71 includes a base portion 73, a plurality of rotor blades 74, and a shroud 75. That is, the impeller 70 includes the base portion 73, the plurality of rotor blades 74, and the shroud 75. The base portion 73 is arranged on the lower side of the rotor blades 74. The impeller 70 includes the plurality of rotor blades 74 and the base portion 73, which is in the shape of a disk and is arranged on the lower side of the rotor blades 74. The base portion 73 includes a through hole 73*a* arranged to pass therethrough in the axial direction in a central portion thereof. A portion of the base portion 73 which lies around the through hole 73*a* defines a slope portion 73*b* in the shape of a conical surface and protruding upward. Each rotor blade 74 is a plate-shaped member which is curved in the circumferential direction and is arranged to extend radially outward from a radially inner side on an upper surface of the base portion 73. Each rotor blade 74 is arranged to stand along the axial direction. The shroud 75 is in the shape of a tapered cylinder with the diameter thereof decreasing with increasing height. A central opening portion of the shroud 75 defines the air inlet 70*a* of the impeller 70. The base portion 73 and the shroud 75 are joined to each other through the rotor blades 74.

Figure 11:
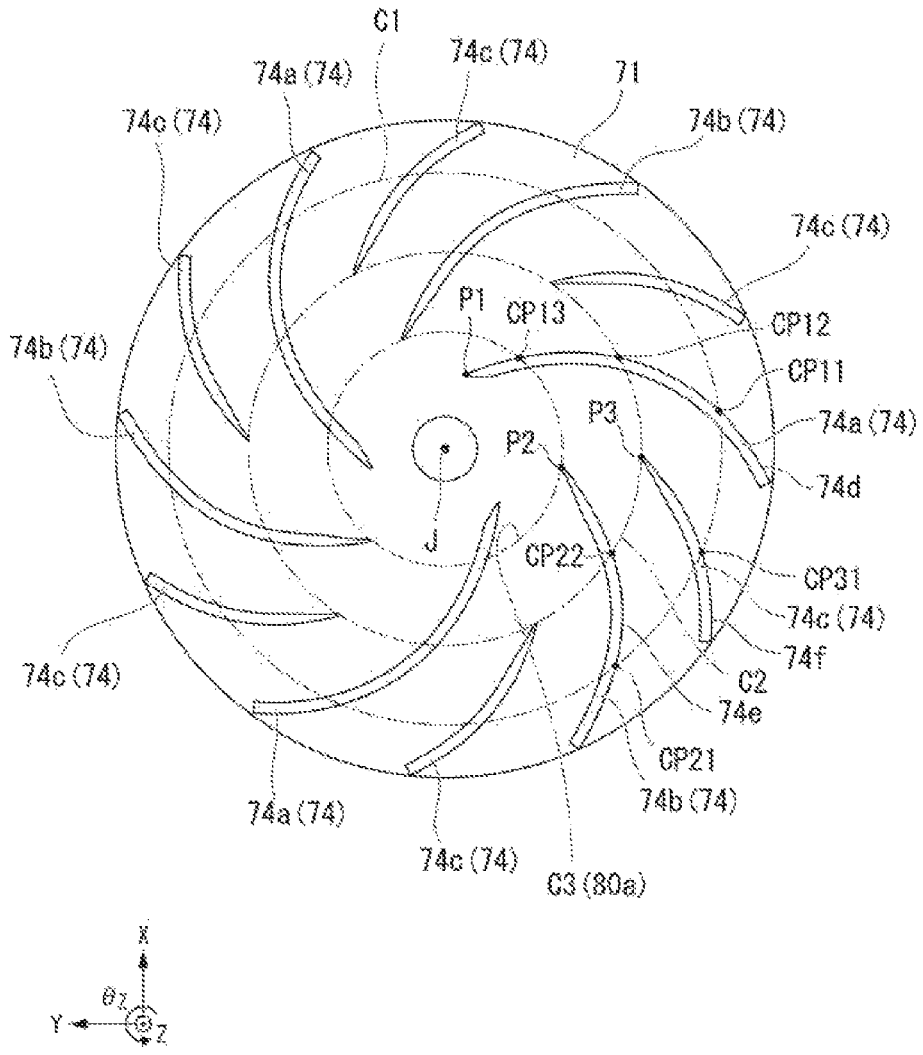
FIG. 11 is a plan view of rotor blades of the impeller.

FIG. 11 is a plan view of the rotor blades 74 of the impeller 70.

As illustrated in FIG. 11, the rotor blades 74 are arranged along the circumferential direction (i.e., the θz direction) on the upper surface of the base portion 73. As illustrated in FIG. 1, each rotor blade 74 is arranged to extend vertically along the axial direction from the upper surface of the base portion 73.

In the present embodiment, three types of rotor blades 74 are arranged such that the rotor blades 74 of the same type are arranged at regular intervals in the circumferential direction. The rotor blades 74 according to the present embodiment include a plurality of (three) first rotor blades 74*a*, a plurality of (three) second rotor blades 74*b*, and a plurality of (six) third rotor blades 74*c*. The three first rotor blades 74*a* are arranged at regular intervals of 120 degrees in the circumferential direction. Each second rotor blade 74*b* is arranged at a midpoint between circumferentially adjacent ones of the first rotor blades 74*a*. The three second rotor blades 74*b* are also arranged at regular intervals of 120 degrees in the circumferential direction. Each third rotor blade 74*c* is arranged at a midpoint between circumferentially adjacent ones of the first rotor blades 74*a* and the second rotor blades 74*b*. The six third rotor blades 74*c* are arranged at regular intervals of 60 degrees in the circumferential direction.

Each rotor blade 74 is arranged to extend in a curve on the upper surface of the base portion 73 in a plan view (i.e., an x-y plan view). One end of the rotor blade 74 is arranged at an outer circumferential edge of the base portion 73. Another end of the rotor blade 74 is arranged radially inward of the outer circumferential edge of the base portion 73.

That is, a radially outer end portion of each of the first rotor blades 74*a*, the second rotor blades 74*b*, and the third rotor blades 74*c* is arranged at the outer circumferential edge of the base portion 73. Meanwhile, a radially inner end portion P1 of each first rotor blade 74*a* is arranged closest to a center of the base portion 73. A radially inner end portion P2 of each second rotor blade 74*b* is arranged radially outward of the end portion P1 of each first rotor blade 74*a*. A radially inner end portion P3 of each third rotor blade 74*c* is arranged radially outward of the end portion P2 of each second rotor blade 74*b*. The above arrangement contributes to reducing turbulence in the impeller 70, and thus improving air blowing efficiency of the impeller 70.

Each of the first rotor blades 74*a*, the second rotor blades 74*b*, and the third rotor blades 74*c* is arranged to curve in a counterclockwise direction.

Each first rotor blade 74*a* includes four circular arcs each of which has a different radius of curvature. A convex blade surface 74*d* of the first rotor blade 74*a* has three points CP11, CP12, and CP13 of curvature change along the length thereof.

Each second rotor blade 74*b* includes three circular arcs each of which has a different radius of curvature. A convex blade surface 74*e* of the second rotor blade 74*b* has two points CP21 and CP22 of curvature change along the length thereof.

Each third rotor blade 74*c* includes two circular arcs each of which has a different radius of curvature. A convex blade surface 74*f* of the third rotor blade 74*c* has one point CP31 of curvature change along the length thereof.

In the present embodiment, the point CP11 of curvature change of each first rotor blade 74*a*, the point CP21 of curvature change of each second rotor blade 74*b*, and the point CP31 of curvature change of each third rotor blade 74*c* are arranged on the same circle C1 in the base portion 73. In addition, a portion of the first rotor blade 74*a* which is radially outside of the circle C1, a portion of the second rotor blade 74*b* which is radially outside of the circle C1, and a portion of the third rotor blade 74*c* which is radially outside of the circle C1 are arranged to have the same radius of curvature.

Next, the point CP12 of curvature change of each first rotor blade 74*a*, the point CP22 of curvature change of each second rotor blade 74*b*, and the end portion P3 of each third rotor blade 74*c* are arranged on the same circle C2 in the base portion 73. In addition, a portion of the first rotor blade 74*a* between the circles C1 and C2, a portion of the second rotor blade 74*b* between the circles C1 and C2, and a portion of the third rotor blade 74*c* between the circles C1 and C2 are arranged to have the same radius of curvature.

Next, the point CP13 of curvature change of each first rotor blade 74*a* and the end portion P2 of each second rotor blade 74*b* are arranged on the same circle C3 in the base portion 73. In addition, a portion of the first rotor blade 74*a* between the circles C2 and C3 and a portion of the second rotor blade 74*b* between the circles C2 and C3 are arranged to have the same radius of curvature.

The rotor blades 74 (74*a* to 74*c*) according to the present embodiment are arranged such that the radius of curvature of each of the blade surfaces 74*d* to 74*f* varies in different radial regions of the impeller 70. Meanwhile, the portions of the rotor blades 74 (i.e., the first to third rotor blades 74*a* to 74*c*), even of the rotor blades 74 of different types, which belong to the same radial region are arranged to have the same radius of curvature.

In the present embodiment, the circle C3 is arranged to coincide with an air inlet 80*a* of the impeller housing 80 when viewed in the axial direction. Therefore, only a portion of the first rotor blade 74*a* which is radially inside of the point CP13 of curvature change is arranged in the air inlet 80*a*.

The impeller hub 72 includes a tubular portion 72*a* arranged to extend in the axial direction, a disk-shaped flange portion 72*b* arranged to extend radially outward from a lower portion of an outer circumferential surface of the tubular portion 72*a*, and a plurality of projection portions 72*c* each of which is arranged to project upward from an upper surface of the flange portion 72*b*. The tubular portion 72*a* includes a tapered slope portion 72*d* with the diameter thereof decreasing with increasing height at an upper end portion thereof.

The impeller hub 72 is attached to the impeller body 71 by the tubular portion 72*a* being inserted from below into the through hole 73*a* of the base portion 73. The tubular portion 72*a* may be press fitted in the through hole 73*a*, or may be fixed therein using an adhesive or the like. The flange portion 72*b* of the impeller hub 72 is arranged to support the impeller body 71 from below. The projection portions 72*c* on the flange portion 72*b* are fitted into recessed portions 73*c* defined in a lower surface of the base portion 73. The fitting of the projection portions 72*c* into the recessed portions 73*c* restrains the impeller body 71 and the impeller hub 72 from circumferential movement relative to each other.

Provision of the flange portion 72*b* in the impeller hub 72 makes it possible to support the impeller body 71 from below over a large radial range with the flange portion 72*b*. Thus, the impeller 70 is held with stability, resulting in increased stability during high-speed rotation. That is, because the impeller body 71 can be supported by the flange portion 72*b* from below over a large radial range, wobbling of the impeller 70 with respect to the shaft 31 can be reduced.

In the impeller 70, the slope portion 72*d* at an upper end of the tubular portion 72*a* of the impeller hub 72 and the slope portion 73*b* of the base portion 73 are smoothly joined to each other from both sides in the vertical direction. The slope portion 72*d* and the slope portion 73*b* together define an annular sloping surface 70*b* arranged to guide the fluid sucked in through the air inlet 70*a* of the impeller 70 radially outward.

Defining the annular sloping surface 70*b* with the impeller body 71 and the impeller hub 72 makes it possible to increase a maximum height of the annular sloping surface 70*b* without increasing the height of the slope portion 73*b* of the base portion 73, by increasing the length of the tubular portion 72*a* (i.e., of the slope portion 72*d*). Thus, the annular sloping surface 70*b*, with a preferable shape, can be realized with a limited increase in the thickness of the base portion 73.

The impeller hub 72 is preferably made of a metal. The shaft 31 and the impeller 70 can thus be securely coupled to each other. This enables the impeller 70 to rotate stably at a high speed. Moreover, because the slope portion 72*d* is a metal surface in this case, an upper end surface of the annular sloping surface 70*b* can be smoothened.

The impeller 70 is fixed to the shaft 31 as a result of an upper end portion of the shaft 31 being fitted into the tubular portion 72*a* of the impeller hub 72 from below. As illustrated in FIGS. 1 and 9, the impeller 70 coupled to the shaft 31 is arranged inside of the annular projecting portion 66*c* of the second stationary vane member 61*b*. Accordingly, the projecting portion 66*c* is arranged in the vicinity of an air outlet 70*c* of the impeller 70.

The projecting portion 66*c* is arranged to project upward from an upper end of the upper stationary vane support ring 66*b*. The projecting portion 66*c* is arranged radially outside of the impeller 70. More specifically, the second stationary vane member 61*b* includes the annular projecting portion 66*c*, which is arranged to project upward and is arranged radially outside of the impeller 70. The projecting portion 66*c* is arranged to guide exhaust air discharged from the impeller 70 downward in combination with an exhaust air guide portion 83 of the impeller housing 80, which will be described below. In the present embodiment, an outer circumferential surface of the projecting portion 66*c* is a slanting surface arranged to slant downward as it extends radially outward. The outer circumferential surface of the projecting portion 66*c* is in the shape of a smooth curved surface being convex outward.

A lower end of the outer circumferential surface of the projecting portion 66*c* is arranged to be smoothly continuous with the outer circumferential surface of the cylindrical upper stationary vane support ring 66*b*. Therefore, the projecting portion 66*c* is, at a lower end thereof, at an angle of about 90 degrees to the horizontal direction. An upper end of the projecting portion 66*c* is arranged immediately radially outside of an outer circumferential end of the base portion 73 of the impeller 70. The upper end of the projecting portion 66*c* is arranged at a level higher than that of the lower surface of the base portion 73 and lower than that of an outer end of the upper surface of the base portion 73.

In the blower apparatus 1 according to the present embodiment, the above-described shape and arrangement of the projecting portion 66*c* allow the air discharged from the impeller 70 to be guided smoothly downward without a disturbance in a flow of the air. At a lower end of the air outlet 70*c* of the impeller 70, the air is discharged substantially horizontally from the outer circumferential end of the base portion 73. In the present embodiment, because the upper end of the projecting portion 66*c* is arranged at a level lower than that of the upper surface of the base portion 73, the air discharged is guided along the outer circumferential surface of the projecting portion 66*c* without colliding against the projecting portion 66*c*. This increases efficiency with which the air is conveyed. In addition, provision of the projecting portion 66*c* contributes to preventing air discharged radially outward from the air outlet 70*c* from flowing into an axial gap between the second stationary vane member 61*b* and the base portion 73.

<Impeller Housing>

The impeller housing 80 is arranged to house the impeller 70, and includes the air inlet 80*a* on the upper side. The impeller housing 80 is in the shape of a tapered cylinder with the diameter thereof decreasing with increasing height. The impeller housing 80 includes an intake air guide portion 81 arranged at an opening end of the air inlet 80*a*. The impeller housing 80 includes an impeller housing body portion 82 arranged to cover an upper side of the impeller 70, the exhaust air guide portion 83, which is arranged to extend radially outward and downward from an outer circumferential edge of the impeller housing body portion 82.

The impeller housing body portion 82 is arranged to have a sectional shape that matches that of the shroud 75 of the impeller 70. An inside surface (i.e., a lower surface) of the impeller housing body portion 82 is arranged opposite to an outside surface (i.e., an upper surface) of the shroud 75 with uniform spacing therebetween.

The intake air guide portion 81, which is annular and is arranged to project radially inward, is arranged at an upper end portion of the impeller housing body portion 82 on the radially inner side. As illustrated in FIG. 9, the intake air guide portion 81 is arranged to cover an upper side of an upper end surface 75*b* of the shroud 75. A narrow gap extending radially is defined between a lower surface of the intake air guide portion 81 and the upper end surface 75*b* of the shroud 75.

An outer circumferential end portion 82*a* of the impeller housing body portion 82 is arranged to bend downward to extend along an outer circumferential end of the shroud 75. A narrow gap extending axially upward is defined between an inner circumferential surface of the outer circumferential end portion 82*a* and an outer end surface of the shroud 75.

The exhaust air guide portion 83 includes a shoulder portion 83*a* arranged to extend over the entire circumferential extent thereof in a radially inner portion of a lower end surface thereof. As illustrated in FIG. 9, the shoulder portion 83*a* is fitted to the shoulder portion 65*a* of the outer circumferential ring 65 of the second stationary vane member 61*b*. The outer circumferential ring 65 is thus fixed to the impeller housing 80. An inner circumferential surface of the exhaust air guide portion 83 and the inner circumferential surface of the outer circumferential ring 65 are smoothly joined to each other in the vertical direction, and together define a radially outer wall surface of an exhaust air channel. The outer circumferential ring 65 is a cylindrical member.

The inner circumferential surface of the exhaust air guide portion 83 is arranged to define an exhaust air channel 92, which is arranged to guide exhaust air discharged radially outward from the impeller 70 downward, together with the outer circumferential surface of the projecting portion 66*c* of the second stationary vane member 61*b*, which is arranged on the lower side of the impeller 70.

As illustrated in FIG. 9, the exhaust air channel 92 is joined to the exhaust air channel 93 of the stationary vane member 60. As illustrated in FIG. 10, the exhaust air channel 93 of the stationary vane member 60 includes channels between the upper stationary vanes 67*a* and channels between the lower stationary vanes 67*b*. The exhaust air channel 93 joins an external space at the air outlet 95.

<Air Blowing Operation>

The blower apparatus 1 according to the present embodiment is arranged to cause the impeller 70 to rotate through the motor 10 to draw air into the impeller 70 through the air inlet 80*a*, and discharge the air radially outward through the air channel in the impeller 70, as illustrated in FIG. 1. The exhaust air discharged from the impeller 70 flows into regions between the upper stationary vanes 67*a* through the exhaust air channel 92. The upper stationary vanes 67*a* control flows of the exhaust air, and discharge the exhaust air downward. The lower stationary vanes 67*b* guide the exhaust air radially outward while directing the direction of flow of the exhaust air downward. Thereafter, the exhaust air is discharged out of the blower apparatus 1 through the air outlet 95.

According to the present embodiment, the upper stationary vanes 67*a*, the upper stationary vane support ring 66*b*, and the outer circumferential ring 65 are defined by a single monolithic member. Here, when they are described as being defined by a single monolithic member, it means that they are defined by a one-piece continuous member. More specifically, it means that they are molded at a time by the same manufacturing process, and it may be that they are defined at a time by a molding process using a mold, for example. The above arrangement allows the width of a radial gap defined between an outer circumference of the upper stationary vane support ring 66*b* and an inner circumference of the outer circumferential ring 65 to be more precisely uniform along the circumferential direction than in the case where they are defined by separate members. This makes it possible to make the channel cross-sectional area of the exhaust air channel 93 uniform along the circumferential direction, and stabilize pressure of the exhaust air along the circumferential direction, thus improving air exhaust efficiency.

A portion of the exhaust air discharged downward from the air outlet 95 flows downward along an outer circumferential surface of the housing 20 of the motor 10. In addition, other portions of the exhaust air discharged from the air outlet 95 flow into the motor 10 through the through holes 25 and 26 defined in the housing 20.

The portion of the exhaust air which has flowed into the motor 10 through each through hole 25 flows into the air channel FP between the stator 40 and the housing 20 as illustrated in FIG. 6. The exhaust air flows downward in the air channel FP. In the air channel FP, the outer circumferential surface of the straight portion 41*c* (of the stator core 41) is exposed as illustrated in FIG. 4, and is cooled by the exhaust air. In the air channel FP, the plate-shaped portions 45 are arranged, and control flows of the exhaust air flowing in the air channel FP. The above structure improves air blowing efficiency of the exhaust air flowing in the air channel FP. After flowing through the air channel FP, the exhaust air is discharged downward through the lower-side opening portion 24 of the motor 10.

The portion of the exhaust air which has flowed into the motor 10 through each through hole 26 flows into the stator 40 through the gap CL as illustrated in FIG. 6. The first side end surface 43*b*, the second side end surface 43*c*, and the slanting member 46 which together define the gap CL guide the exhaust air passing through the gap CL toward a side surface of a corresponding one of the coils 42. Specifically, provision of the slanting member 46 contributes to preventing the exhaust air passing through the gap CL from striking against the upper surface of the circular arc portion 41*d*, thus reducing a reduction in air exhaust efficiency. This structure enables each coil 42, which is a heat-radiating portion of the motor 10, to be cooled efficiently. The exhaust air flows downward around the coil 42, and is discharged downward through the through hole 22*a* defined in the lower surface of the motor 10.

In the blower apparatus 1 according to the present embodiment, the air outlet 95, which is annular around the axis, is arranged above the motor 10. This eliminates the need to provide an air channel member for the exhaust air on the radially outer side of the motor 10. As a result, the motor 10 with an increased diameter can be used to improve air-blowing performance of the blower apparatus 1 without an increase in the diameter of the blower apparatus 1. Alternatively, a reduction in the size of the blower apparatus 1 can be achieved with the air-blowing performance thereof remaining the same.

Note that it may be sufficient if the air outlet 95 is arranged above the stator 40. Since the relationship between the diameter and performance of the motor 10 is determined on the basis of the size of the stator 40, a portion of the air outlet 95 can be arranged radially inward of a radially outer end of the motor 10 if the air outlet 95 is arranged above at least the stator 40.

In addition, in the present embodiment, the blower apparatus 1 includes the three gaps CL and the three air channels FP. This arrangement enables the stator core 41 and the coils 42 to be efficiently cooled with air flowing radially inward through each gap CL, and enables the stator core 41 to be cooled with air flowing in the axial direction through each air channel FP.

<First Modification>

Figure 12:
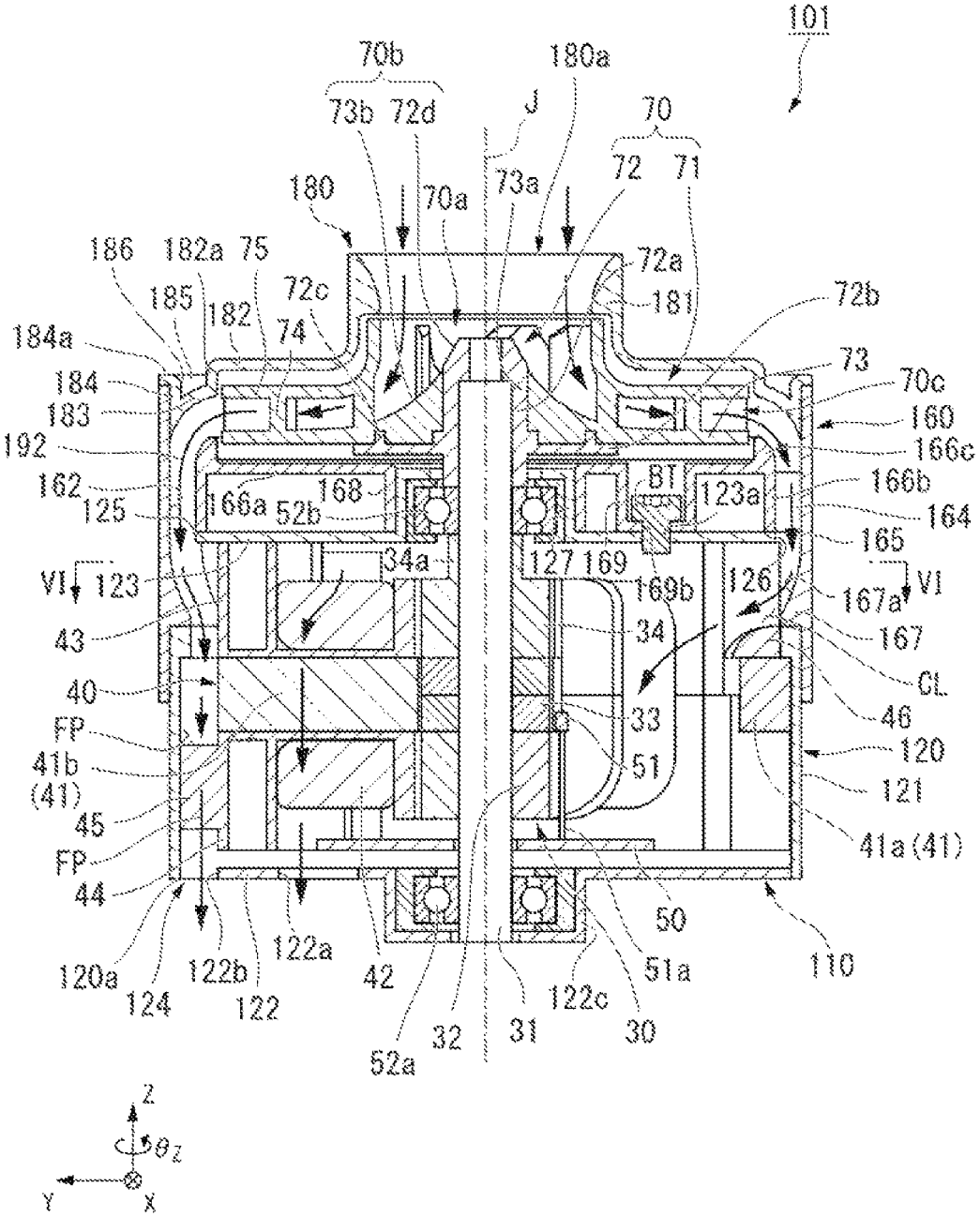
FIG. 12 is a sectional view illustrating a blower apparatus according to a first modification of the above embodiment of the present invention.
Figure 13:
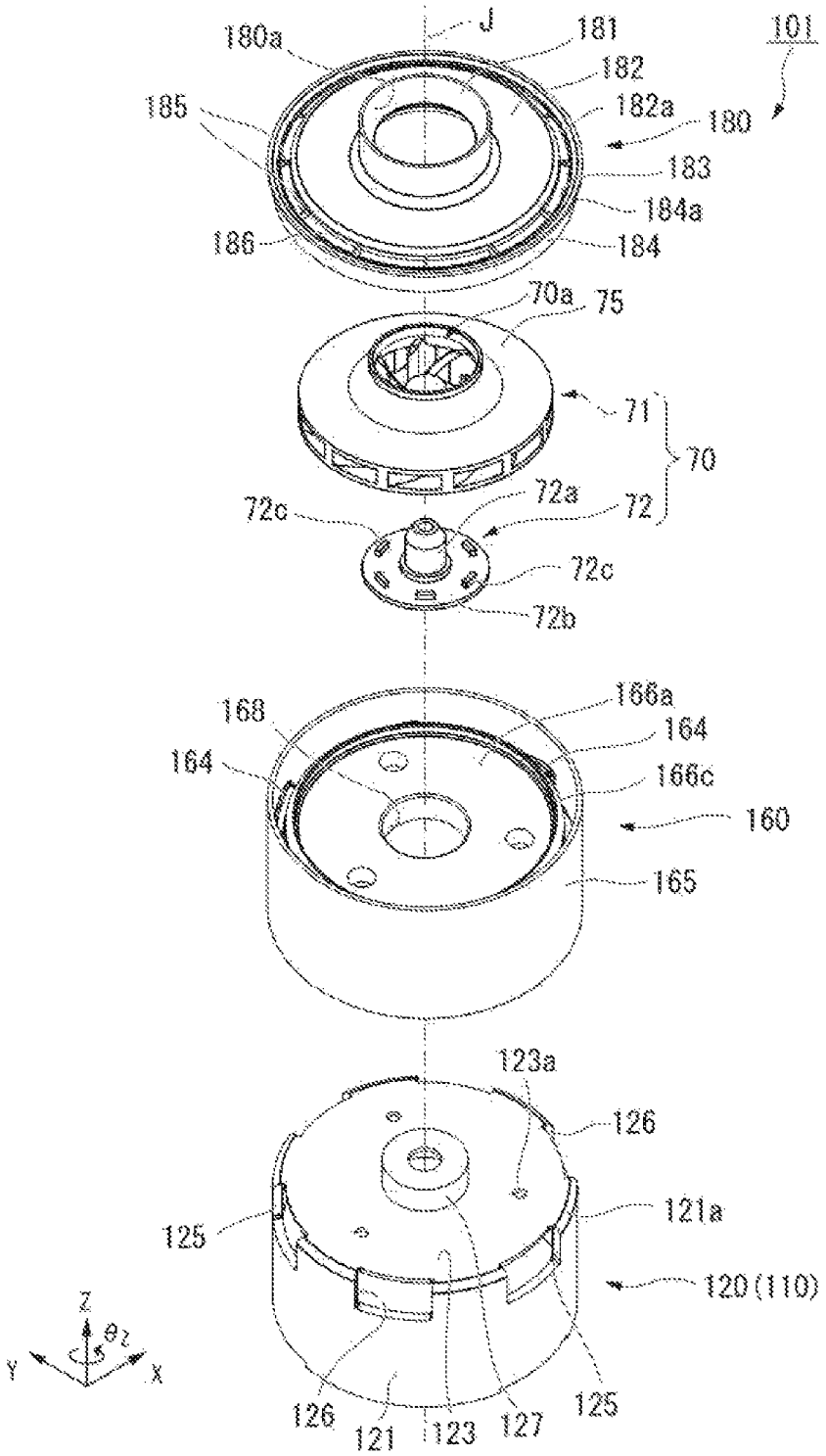
FIG. 13 is an exploded perspective view of the blower apparatus according to the first modification.

FIG. 12 is a sectional view illustrating a blower apparatus 101 according to a first modification. FIG. 13 is an exploded perspective view of the blower apparatus 101 according to the present modification. Note that members or portions that have their equivalents in the above-described embodiment are denoted by the same reference numerals as those of their equivalents in the above-described embodiment, and descriptions of those members or portions are omitted.

As illustrated in FIGS. 12 and 13, the blower apparatus 101 includes a motor 110, an impeller 70, an exhaust air guide member (i.e., a stationary vane support portion) 160, and an impeller housing 180.

The exhaust air guide member 160 is attached on the upper side (i.e., the +z side) of the motor 110. The impeller housing 180 is attached on the upper side of the exhaust air guide member 160. The impeller 70 is housed in a space between the exhaust air guide member 160 and the impeller housing 180. The impeller 70 is attached to the motor 110 such that the impeller 70 is rotatable about a central axis J.

[Motor]

Figure 14:
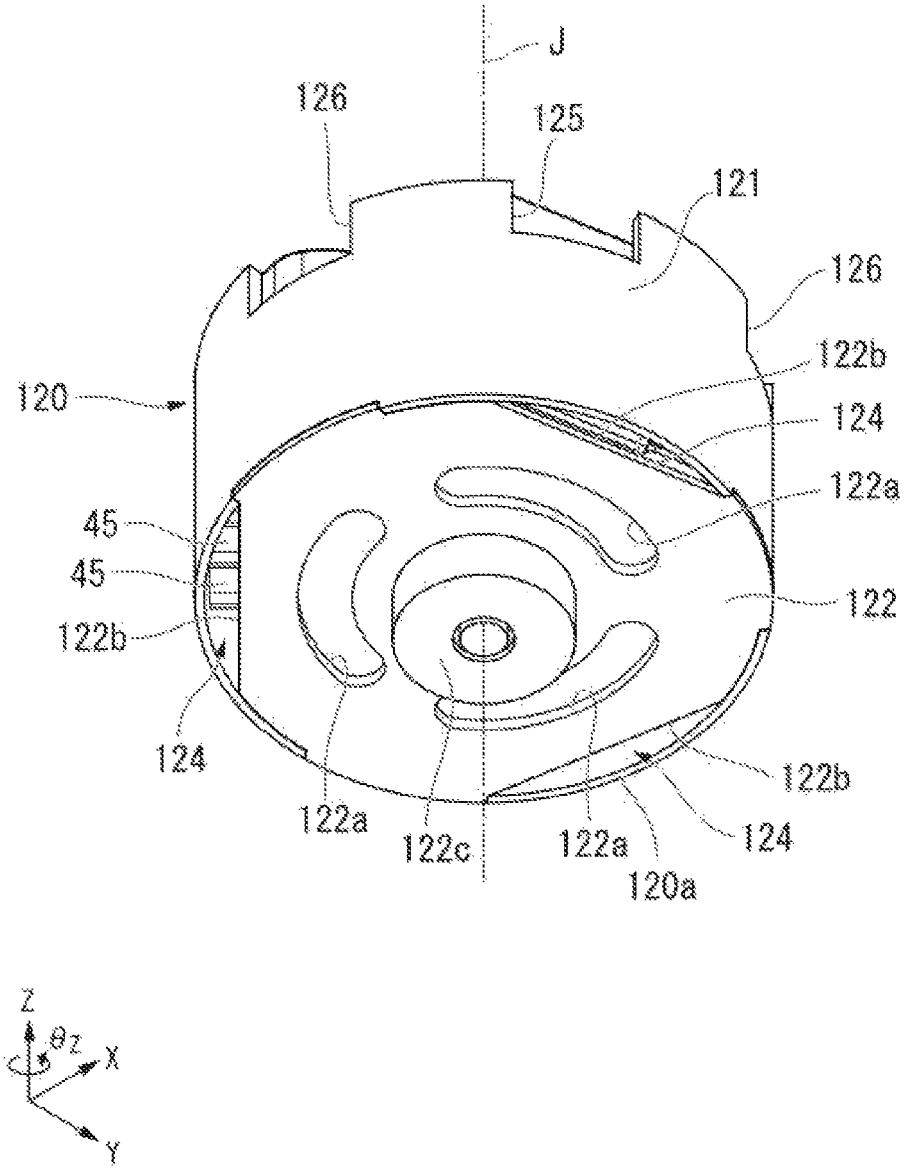
FIG. 14 is a perspective view of a motor according to the first modification as viewed from below.

FIG. 14 is a perspective view of the motor according to the present modification as viewed from below.

As illustrated in FIG. 12, the motor 110 includes a housing 120, a lower lid 122, a rotor 30 including a shaft 31, a stator 40, a circuit board 50, a lower-side bearing 52*a*, and an upper-side bearing 52*b*.

The housing 120 is a cylindrical container having a lid and arranged to house the rotor 30 and the stator 40. The housing 120 is arranged to surround the stator 40 from radially outside. The housing 120 includes a cylindrical circumferential wall 121, an upper lid portion 123 arranged at an upper end of the circumferential wall 121, and an upper-side bearing holding portion 127 arranged at a central portion of the upper lid portion 123. The stator 40 is fixed to an inside surface of the housing 120. The upper-side bearing holding portion 127 is tubular, and is arranged to project upward from the central portion of the upper lid portion 123. The upper-side bearing holding portion 127 is arranged to hold the upper-side bearing 52*b* therein.

As illustrated in FIG. 13, an edge portion 121*a* between the upper lid portion 123 and the circumferential wall 121 of the housing 120 is provided with a plurality of through holes 125 and 126. The through holes 125, which are arranged at three separate positions, and the through holes 126, which are also arranged at three separate positions, are arranged to alternate with each other around the axis (see FIG. 6). Each of the through holes 125 and 126 is arranged to extend from an upper end of the circumferential wall 121 up to an outer edge portion of the upper lid portion 123. Each of the through holes 125 and 126 is arranged to pass through the circumferential wall 121 in a radial direction. In addition, each of the through holes 125 and 126 is arranged to pass through the upper lid portion 123 in the vertical direction in the vicinity of the radially outer edge portion of the upper lid portion 123.

The lower lid 122 is attached to an opening portion on the lower side (i.e., the −z side) of the housing 120. A tubular lower-side bearing holding portion 122*c*, which is arranged to project downward from a lower surface of the lower lid 122, is arranged at a central portion of the lower lid 122. The lower-side bearing holding portion 122*c* is arranged to hold the lower-side bearing 52*a*.

As illustrated in FIG. 14, the lower lid 122 includes three through holes 122*a*, each of which is in the shape of a circular arc and has a radial width, at three positions around the axis. Three cut portions 122*b*, each of which is defined by cutting an outer circumferential portion of the lower lid 122 in a straight manner, are defined at an outer circumferential end of the lower lid 122. A gap between each cut portion 122*b* and an opening end 120*a* on the lower side of the housing 120 defines a lower-side opening portion 124 of the motor 110.

[Exhaust Air Guide Member, Impeller, and Impeller Housing]

Next, the exhaust air guide member 160, the impeller 70, and the impeller housing 180 will now be described below.

Figure 15:
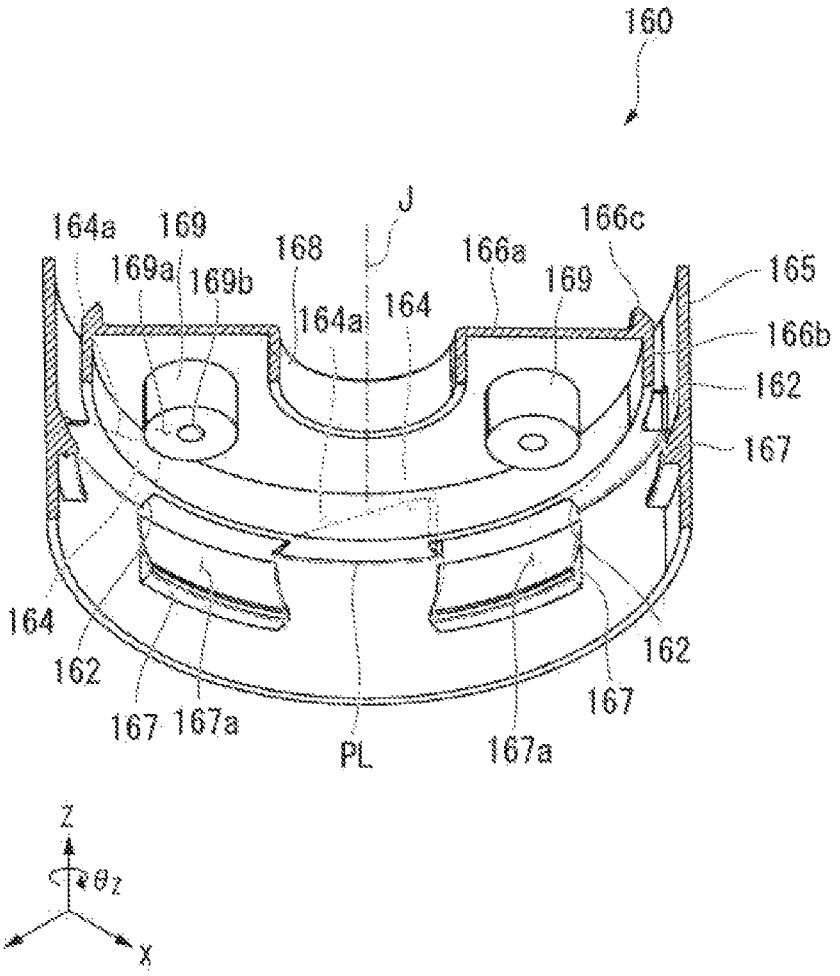
FIG. 15 is a partial perspective sectional view of an exhaust air guide member according to the first modification.
Figure 16:
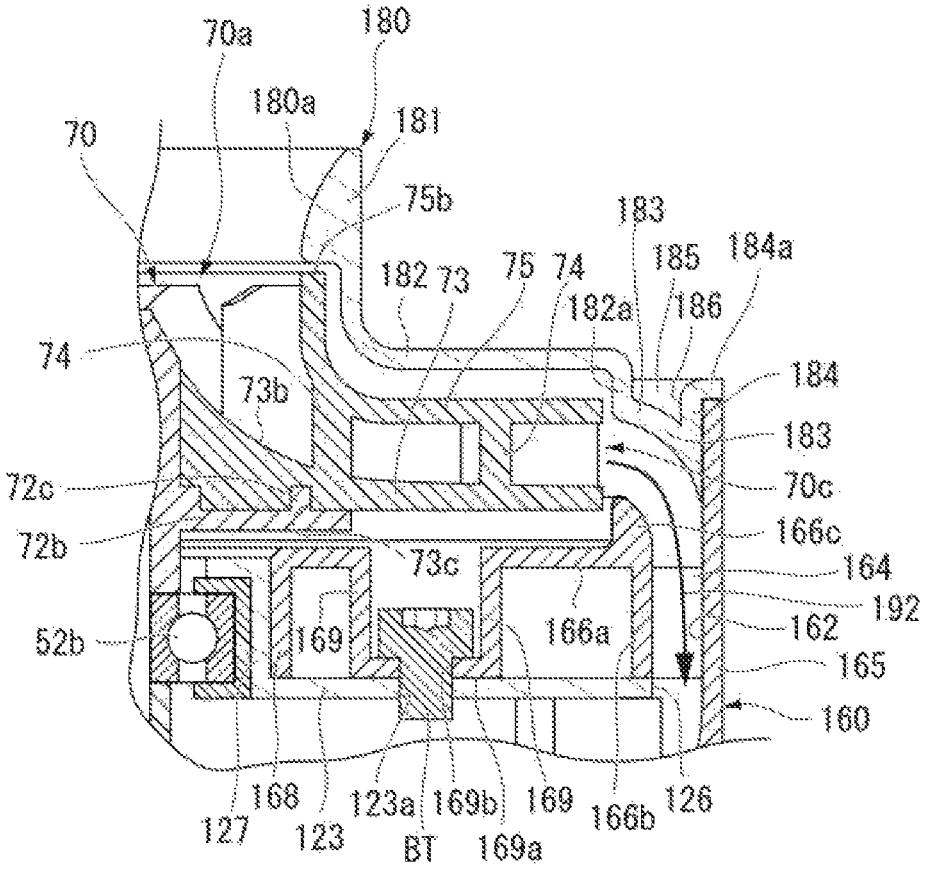
FIG. 16 is a sectional view illustrating portions of an impeller, the exhaust air guide member, and an impeller housing according to the first modification in an enlarged form.

FIG. 15 is a partial perspective sectional view of the exhaust air guide member 160 as viewed from below. FIG. 16 is a sectional view illustrating portions of the impeller 70, the exhaust air guide member 160, and the impeller housing 180 in an enlarged form.

The exhaust air guide member (i.e., the stationary vane support portion) 160 is attached to the motor 110. The exhaust air guide member 160 includes a support body 166*a* in the shape of a ring disk, a cylindrical partition ring (i.e., a first ring) 166*b* arranged to extend downward from an outer circumferential edge of the support body 166*a*, a plurality of (six in the illustrated example) upper-side guide portions (i.e., stationary vanes) 164, a tubular outer circumferential tube portion (i.e., a second ring) 165 joined to the upper-side guide portions 164 on the radially outer side, an annular projecting portion 166*c* arranged to project upward from an outer circumferential edge of the support body 166*a*, and a plurality of (six in the illustrated example) lower-side guide portions 167 arranged on an inner circumferential surface of the outer circumferential tube portion 165 on the lower side of the upper-side guide portions 164. Each of the upper-side guide portions 164 is arranged to extend in a radial direction to join an outer circumferential surface of the partition ring 166*b* and the inner circumferential surface of the outer circumferential tube portion 165 to each other. That is, the upper-side guide portions 164, the partition ring 166*b*, and the outer circumferential tube portion 165 together define a portion of the exhaust air guide member 160, which is defined by a single monolithic member.

Note that, in the present modification, the exhaust air guide member 160 corresponds to the "stationary vane support portion", the partition ring 166*b* corresponds to the "first ring", the upper-side guide portions 164 correspond to the "stationary vanes", and the outer circumferential tube portion 165 corresponds to the "second ring".

As illustrated in FIG. 15, the support body 166*a* includes a cylindrical fitting ring 168 arranged to extend downward from a lower surface of a central portion thereof, and three columnar projection portions 169 each of which is arranged to project downward from a lower surface of the support body 166*a*.

The three columnar projection portions 169 are arranged to have equivalent diameters and heights, and are arranged at regular intervals of 120 degrees in the circumferential direction. In the present modification, each columnar projection portion 169 is hollow, and includes a through hole 169*b* arranged to pass therethrough in the axial direction in a center of a lower end surface 169*a* thereof.

The exhaust air guide member 160 is attached to the housing 120 of the motor 110. As illustrated in FIG. 16, the upper-side bearing holding portion 127 of the housing 120 is inserted in the fitting ring 168 of the exhaust air guide member 160. A lower surface of the fitting ring 168 and the lower end surface 169*a* of each columnar projection portion 169 of the exhaust air guide member 160 are arranged to be in contact with an upper surface of the upper lid portion 123 of the housing 120. A bolt BT is inserted through the through hole 169*b* of each columnar projection portion 169 and a corresponding screw hole 123*a* of the upper lid portion 123 to fasten the exhaust air guide member 160 to the motor 110.

As illustrated in FIG. 15, each upper-side guide portion 164 is arranged to have a triangular shape, with an upper surface 164*a* thereof being inclined when viewed in a radial direction. The upper surface 164*a* is arranged to incline downward as it extends in a rotation direction of the impeller. A vertical through hole 162 passing through in the vertical direction is defined between every adjacent ones of the upper-side guide portions 164. The number of vertical through holes 162 is the same (three in the illustrated example) as the number of upper-side guide portions 164. Each upper-side guide portion 164 is arranged to guide exhaust air flowing in a direction angled toward the rotation direction of the impeller 70 to an adjacent one of the vertical through holes 162 efficiently in accordance with the inclination of the upper surface 164*a*.

Each of the lower-side guide portions 167 is arranged under a separate one of the vertical through holes 162. Each lower-side guide portion 167 is arranged to project radially inward from the inner circumferential surface of the outer circumferential tube portion 165. The lower-side guide portions 167 are fitted in the through holes 125 and 126 of the housing 120. The extent to which each lower-side guide portion 167 projects radially inward is arranged to gradually increase with decreasing height. Each lower-side guide portion 167 includes a slanting surface 167*a* arranged to slant gradually radially inward with decreasing height. The slanting surface 167*a* is arranged to guide exhaust air which has passed through an adjacent one of the vertical through holes 162 into the motor 110 through a corresponding one of the through holes 125 and 126 on the radially inner side.

The exhaust air guide member 160 can be produced by a molding process. In a case where the exhaust air guide member 160 is made of a resin material, the exhaust air guide member 160 is manufactured by, for example, an injection molding process. The lower-side guide portions 167 of the exhaust air guide member 160 are arranged directly below the respective vertical through holes 162. The slanting surface 167*a* of each lower-side guide portion 167 is arranged to face the upper side with the corresponding vertical through hole 162 therebetween. All surfaces of the exhaust air guide member 160 which face the upper side are arranged at such positions that they can be seen from the upper side. In other words, all the surfaces of the exhaust air guide member 160 which face the upper side are arranged at mutually different positions when viewed from the upper side. Similarly, all surfaces thereof which face the lower side are arranged at mutually different positions when viewed from the lower side. Accordingly, the exhaust air guide member 160 can be molded using a pair of upper and lower molds (i.e., an upper mold and a lower mold). More specifically, the exhaust air guide member 160 can be produced at a low cost without the need to use a slide mold which is moved in a direction other than the axial direction, with the surfaces thereof which face the upper side being defined by the upper mold, and the surfaces thereof which face the lower side being defined by the lower mold.

Here, a surface which faces the upper side means a surface of which a normal vector has a positive z vector component. Meanwhile, a surface which faces the lower side means a surface of which a normal vector has a negative z vector component. Therefore, a surface which faces obliquely upward is a surface which faces the axially upper side, and a surface which faces obliquely downward is a surface which faces the axially lower side.

As illustrated in FIG. 15, a parting line PL of the exhaust air guide member 160 extends from an upper end of the slanting surface 167*a* of each lower-side guide portion 167 along a lower surface of an adjacent one of the upper-side guide portions 164.

The impeller 70 is arranged to discharge a fluid sucked in through an air inlet 70*a* which opens upward radially outward through an internal channel. The impeller 70 includes an impeller body 71 and an impeller hub 72.

The impeller 70 is fixed to the shaft 31 as a result of an upper end portion of the shaft 31 being fitted into a tubular portion 72*a* of the impeller hub 72 from below. As illustrated in FIGS. 12 and 16, the impeller 70 coupled to the shaft 31 is arranged inside of the annular projecting portion 166*c* of the exhaust air guide member 160. Accordingly, the projecting portion 166*c* is arranged in the vicinity of an air outlet 70*c* of the impeller 70.

The projecting portion 166*c* is arranged to guide exhaust air discharged from the impeller 70 downward in combination with an exhaust air guide portion 183 of the impeller housing 180, which will be described below. In the present modification, an outer circumferential surface of the projecting portion 166*c* is a slanting surface arranged to slant downward as it extends radially outward. The outer circumferential surface of the projecting portion 166*c* is in the shape of a smooth curved surface being convex outward.

A lower end of the outer circumferential surface of the projecting portion 166*c* is arranged to be smoothly continuous with the outer circumferential surface of the partition ring 166*b*, which is cylindrical. Therefore, the projecting portion 166*c* is, at a lower end thereof, at an angle of about 90 degrees to the horizontal direction. An upper end of the projecting portion 166*c* is arranged immediately radially outside of an outer circumferential end of a base portion 73 of the impeller 70. The upper end of the projecting portion 166*c* is arranged at a level higher than that of a lower surface of the base portion 73 and lower than that of an upper surface of an outer circumferential end of the base portion 73.

In the blower apparatus 101 according to the present modification, the above-described shape and arrangement of the projecting portion 166*c* allow the air discharged from the impeller 70 to be guided smoothly downward without a disturbance in a flow of the air. At a lower end of the air outlet 70*c* of the impeller 70, the air is discharged substantially horizontally from the outer circumferential end of the base portion 73. In the present modification, because the upper end of the projecting portion 166*c* is arranged at a level lower than that of the upper surface of the base portion 73, the air discharged is guided along the outer circumferential surface of the projecting portion 166*c* without colliding against the projecting portion 166*c*. This increases efficiency with which the air is conveyed.

As illustrated in FIGS. 12 and 16, the impeller housing 180 includes an air inlet 180*a* on the upper side, and is in the shape of a tapered cylinder with the diameter thereof decreasing with increasing height. The impeller housing 180 includes an intake air guide portion 181 arranged at an opening end of the air inlet 180*a*, an impeller housing body portion 182 arranged to house the impeller 70, the exhaust air guide portion 183, which is arranged to extend in the shape of a skirt radially outward and downward from an outer circumferential edge of the impeller housing body portion 182, and an outer circumferential fitting ring 184 arranged to extend upward from an outer circumferential edge of the exhaust air guide portion 183.

The impeller housing body portion 182 is arranged to cover an upper side of the impeller 70. The impeller housing body portion 182 is arranged to have a sectional shape that matches that of a shroud 75 of the impeller 70. An inside surface (i.e., a lower surface) of the impeller housing body portion 182 is arranged opposite to an outside surface (i.e., an upper surface) of the shroud 75 with uniform spacing therebetween.

The intake air guide portion 181, which is annular and is arranged to project radially inward, is arranged at an upper end portion of the impeller housing body portion 182 on the radially inner side. As illustrated in FIG. 16, the intake air guide portion 181 is arranged to cover an upper side of an upper end surface 75*b* of the shroud 75. A narrow gap extending radially is defined between a lower surface of the intake air guide portion 181 and the upper end surface 75*b* of the shroud 75.

A peripheral bend portion 182*a*, which is bent downward to extend along an outer circumferential end of the shroud 75, is arranged at an outer circumferential end portion of the impeller housing body portion 182. The peripheral bend portion 182*a* is arranged to extend downward to surround an outer end surface of the shroud 75 from radially outside. A narrow gap extending axially upward is defined between an inner circumferential surface of the peripheral bend portion 182*a* and the outer end surface of the shroud 75.

The exhaust air guide portion 183 is arranged to extend radially outward and downward from the outer circumferential edge of the impeller housing body portion 182. As illustrated in FIG. 12, the exhaust air guide portion 183 is arranged to define an exhaust air channel 192 to guide exhaust air which has been discharged radially outward from the impeller 70 downward. An inner circumferential surface of the exhaust air guide portion 183 is arranged to gently slope, changing its direction from horizontal toward vertical as it extends from an upper end to a lower end thereof. The inner circumferential surface of the exhaust air guide portion 183 is, at the lower end thereof, smoothly joined to the inner circumferential surface of the outer circumferential tube portion 165 of the exhaust air guide member 160 to define a radially outer wall surface of the exhaust air channel 192.

The outer circumferential fitting ring 184 is arranged to extend upward from the outer circumferential edge of the exhaust air guide portion 183, and is fixed to the outer circumferential tube portion 165. The outer circumferential fitting ring 184 is arranged to have a cylindrical shape. The outer circumferential fitting ring 184 includes a flange portion 184*a* arranged to extend radially outward from an upper end thereof. An outer circumferential surface of the outer circumferential fitting ring 184 is fitted to the inner circumferential surface of the outer circumferential tube portion 165 of the exhaust air guide member 160. In addition, the flange portion 184*a* is arranged to be in contact with an upper end of the outer circumferential tube portion 165 to determine the vertical position of the impeller housing 180 with respect to the exhaust air guide member 160.

A recessed portion 186 arranged to extend in the circumferential direction is defined in an upper surface of the exhaust air guide portion 183. The recessed portion 186 is arranged on the upper side of the exhaust air guide portion 183. The recessed portion 186 is recessed downward. The recessed portion 186 is defined by the peripheral bend portion 182*a*, the exhaust air guide portion 183, and the outer circumferential fitting ring 184. Provision of the recessed portion 186 in the impeller housing 180 makes the thickness of the exhaust air guide portion 183 uniform. In addition, ribs 185, each of which is arranged to extend in a radial direction to join the outer circumferential fitting ring 184 and the peripheral bend portion 182*a* of the impeller housing body portion 182 to each other, are arranged in the recessed portion 186.

The impeller housing 180 is produced by a molding process. Specifically, a material in a fluid state is poured into a gap between two or more molds, and is cured to manufacture the impeller housing 180. The impeller housing 180 according to present modification is made of a resin material, and is produced by an injection molding process. The impeller housing 180 may alternatively be made of an aluminum alloy, and in this case, the impeller housing 180 is produced by an aluminum die-casting process. When a casting is manufactured by a molding process, a sink mark may occur in a surface of a thick portion thereof as a result of a shrinkage when a material solidifies, which might result in reduced dimensional accuracy. Meanwhile, in the case where the aluminum die-casting process is performed, an air hole (i.e., a blowhole) may occur in a thick portion, resulting in reduced strength.

In the impeller housing 180 according to the present modification, the recessed portion 186 is defined between the outer circumferential fitting ring 184 and the peripheral bend portion 182*a* of the impeller housing body portion 182. As a result, the thickness of the exhaust air guide portion 183 of the impeller housing 180 is made uniform, reducing the likelihood that a sink mark will occur in the exhaust air guide portion 183 or its vicinity. In addition, similarly, the impeller housing 180 is able to reduce the likelihood that an air hole will occur in the exhaust air guide portion 183. Further, the impeller housing 180 according to the present modification is able to achieve increased rigidity of the outer circumferential fitting ring 184 in relation to the impeller housing body portion 182, with the ribs 185 being arranged in the recessed portion 186. As a result, the impeller housing 180 can be securely fixed to the exhaust air guide member 160 at the outer circumferential fitting ring 184.

The blower apparatus 101 according to the present modification is arranged to cause the impeller 70 to rotate through the motor 110 to draw air into the impeller 70 through the air inlet 180*a*, and discharge the air radially outward through an air channel in the impeller 70, as illustrated in FIG. 12. The exhaust air discharged from the impeller 70 flows into the exhaust air guide member 160 through the exhaust air channel 192. The exhaust air channel 192 is arranged between the inner circumferential surface of the exhaust air guide portion 183 of the impeller housing 180 and the outer circumferential surface of the projecting portion 166*c*. The exhaust air channel 192 directs the exhaust air discharged radially outward from the impeller 70 downward to cause the exhaust air to flow into regions between the upper-side guide portions 164. The upper-side guide portions 164 guide the exhaust air discharged from the impeller 70, which has a circumferential flow component, smoothly downward into the vertical through holes 162. After passing through the vertical through holes 162, the exhaust air flows downward along the inner circumferential surface of the outer circumferential tube portion 165, and is guided radially inward by the lower-side guide portions 167 to flow into the motor 110 through the through holes 125 and 126.

Exhaust air which has flowed into the motor 110 through each through hole 125 flows into an air channel FP between the stator 40 and the housing 120 as illustrated in FIG. 12. The exhaust air flows downward in the air channel FP. In the air channel FP, an outer circumferential surface of a straight portion 41*c* (of a stator core 41) is exposed as illustrated in FIG. 4, and is cooled by the exhaust air. In the air channel FP, a plurality of plate-shaped portions 45 are arranged, and control flows of the exhaust air flowing in the air channel FP. After flowing through the air channel FP, the exhaust air is discharged downward through the lower-side opening portion 124 of the motor 110

Exhaust air which has flowed into the motor 110 through each through hole 126 flows into the stator 40 through a gap CL as illustrated in FIG. 12. A first side end surface 43*b*, a second side end surface 43*c*, and a slanting member 46 which together define the gap CL guide the exhaust air passing through the gap CL toward a side surface of a corresponding one of coils 42. This structure enables each coil 42, which is a heat-radiating portion of the motor 110, to be cooled efficiently. The exhaust air flows downward around the coil 42, and is discharged downward through the through hole 122*a* defined in a lower surface of the motor 110.

In the blower apparatus 101 according to the present modification, the exhaust air discharged radially outward from the impeller 70 can be smoothly guided into the motor 110 by the exhaust air guide portion 183, the upper-side guide portions 164, and the lower-side guide portions 167. Accordingly, the motor 110 can be cooled with air exhaust efficiency of the blower apparatus 101 being maintained at a high level.

In the present modification, which has been described by way of example, the exhaust air guide member 160 and the housing 120 are defined by members separate from each other in the vertical direction. Note, however, that the exhaust air guide member 160 and the housing 120 may alternatively be defined by a single monolithic member. In this case, coaxiality of the exhaust air guide member 160 with the motor 110 can be improved to make the exhaust air channel 192 more precisely symmetric with respect to the central axis J of the motor 110, which will result in increased stability of pressure in the channel.

<Second Modification>

Figure 17:
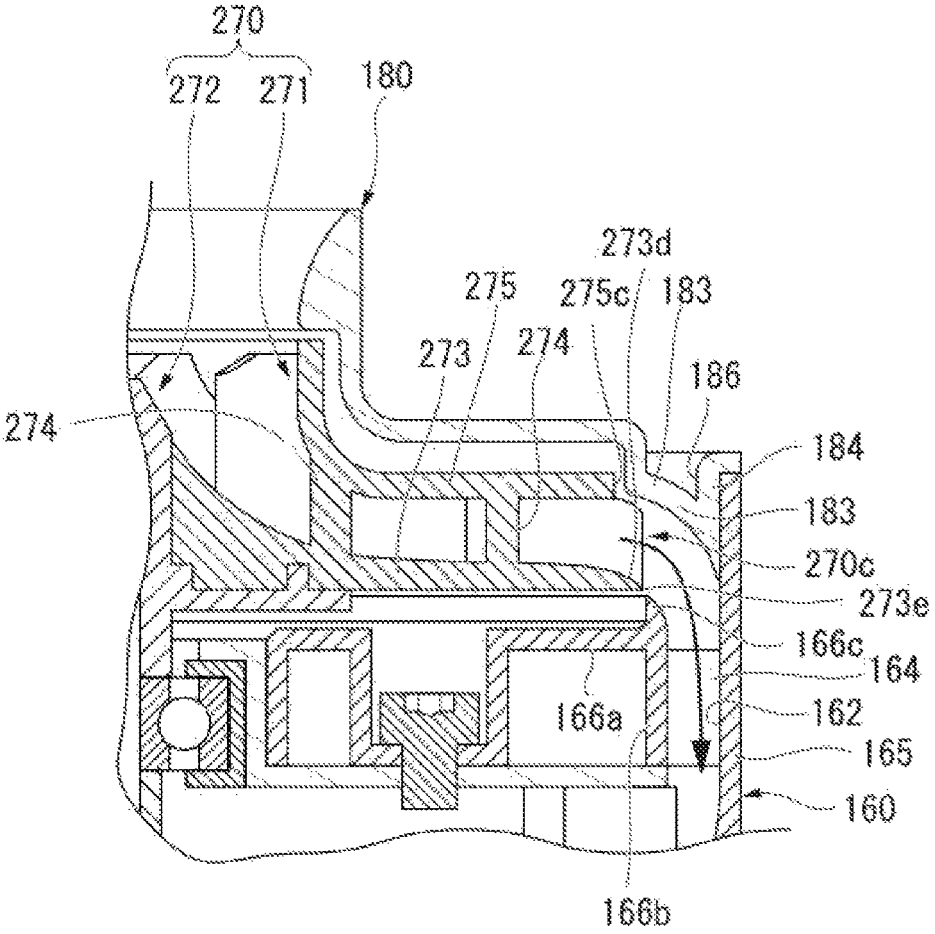
FIG. 17 is a sectional view illustrating an impeller which can be adopted in a second modification of the above embodiment of the present invention.

Next, an impeller 270 which may be adopted in place of the impeller 70 according to each of the above-described embodiment and the modification thereof will now be described below with reference to FIG. 17. Note that members or portions that have their equivalents in the above-described embodiment and the modification thereof are denoted by the same reference numerals as those of their equivalents in the above-described embodiment and the modification thereof, and descriptions of those members or portions are omitted.

The impeller 270 includes an impeller body 271 and an impeller hub 272. The impeller body 271 includes a base portion 273, a plurality of rotor blades 274, and a shroud 275. That is, the impeller 270 includes the base portion 273, the rotor blades 274, and the shroud 275. The base portion 273 is arranged on the lower side of the rotor blades 274. The base portion 273 is in the shape of a disk. The shroud 275 is arranged to extend radially inward with increasing height on the upper side of the rotor blades 274. That is, the shroud 275 is in the shape of a tapered cylinder. The base portion 273 and the shroud 275 are joined to each other through the rotor blades 274.

An upper surface of the base portion 273 includes a base portion slanting portion 273*d* arranged to slant axially downward as it extends radially outward. Provision of the base portion slanting portion 273*d* allows air to be discharged obliquely downward along the base portion slanting portion 273*d* at a lower end of an air outlet 270*c* of the impeller 270. The air discharged from the impeller 270 is guided downward along an inner circumferential surface of an exhaust air guide portion 183. By being discharged obliquely downward by the impeller 270, the exhaust air can change its direction of flow downward with increased smoothness, which will result in improved air exhaust efficiency.

Further, the provision of the base portion slanting portion 273*d* makes it possible to reduce the size of a projecting portion 166*c* arranged radially outside of the base portion 273, and make the diameter of the base portion 273 greater than the diameter of the shroud 275. That is, it is made possible to arrange an outer edge 273*e* of the base portion 273 radially outward of an outer edge 275*c* of the shroud 275. It is therefore made possible to increase the diameter of the impeller 270 (in particular, that of each rotor blade 274) without increasing dimensions of the shroud 275. Generally speaking, an increase in diameter of an impeller leads to higher power output of a blower apparatus even with a low rotation rate. The present modification is able to provide a blower apparatus having high power output despite a small radial dimension and a low rotation rate.

<Third Modification>

Next, a blower apparatus 301 according to a third modification will now be described below with reference to the drawings. It is assumed in a description of the present modification that a direction parallel to a central axis of the blower apparatus is referred to by the term "axial direction", "axial", or "axially", that directions perpendicular to the central axis of the blower apparatus are each referred to by the term "radial direction", "radial", or "radially", and that a direction along a circular arc centered on the central axis of the blower apparatus is referred to by the term "circumferential direction", "circumferential", or "circumferentially". It is also assumed in the description of the present modification that an axial direction is a vertical direction, and that a side on which an impeller is arranged with respect to a motor is defined as an upper side. The shape of each member or portion and relative positions of different members or portions will be described based on the above assumptions. It should be noted, however, that the above definitions of the vertical direction and the upper side are not meant to restrict in any way the orientation of a blower apparatus according to any embodiment of the present invention when in use.

Figure 18:
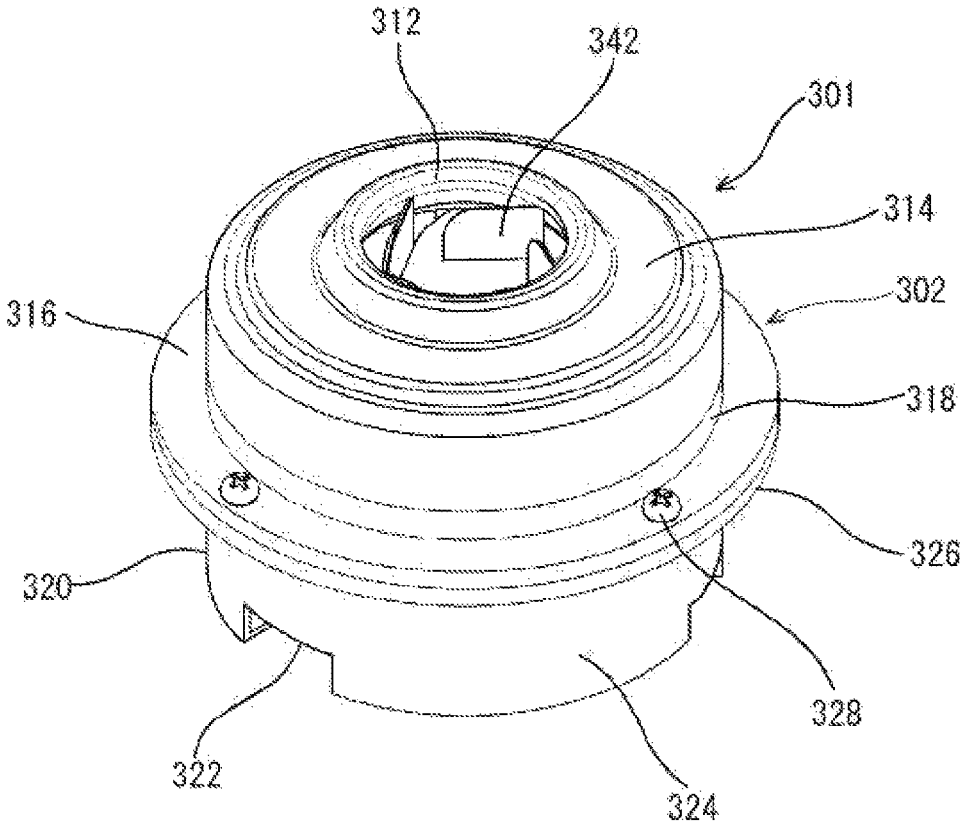
FIG. 18 is a perspective view illustrating a blower apparatus according to a third modification of the above embodiment of the present invention.

FIG. 18 is a perspective view illustrating the overall structure of the blower apparatus 301. The blower apparatus 301 includes an impeller cover portion (i.e., an impeller housing) 314 and a body cover portion 302 arranged in an outer portion thereof. The impeller cover portion 314 is a member in the shape of a cap, made of a metal, and including an air inlet 312 defined in a central portion of an upper surface thereof. The body cover portion 302 includes an upper cover 318 and a lower cover 320. The upper cover 318 includes a cylindrical portion to which a cylindrical portion of the impeller cover portion 314 is fitted from radially outside. The upper cover 318 is a resin-molded article including an upper flange portion 316 defined integrally with a lower end of the cylindrical portion of the upper cover 318. The lower cover 320 is a resin-molded article including a lower cylindrical portion 324, which includes a plurality of air outlets 322 defined in a lower portion of an outer circumference thereof, and a lower flange portion 326 defined integrally with an upper end of the lower cylindrical portion 324. The upper flange portion 316 and the lower flange portion 326, which are arranged above and below, respectively, are joined to each other through screws 328, so that the upper cover 318 and the lower cover 320 are joined to each other. More specifically, screw insert holes are defined at several circumferential positions in the upper flange portion 316, while screw holes are defined at several circumferential positions in the lower flange portion 326 such that the screw holes are opposed to the screw insert holes, and the screws 328 are screwed into the screw holes through the screw insert holes.

Figure 19:
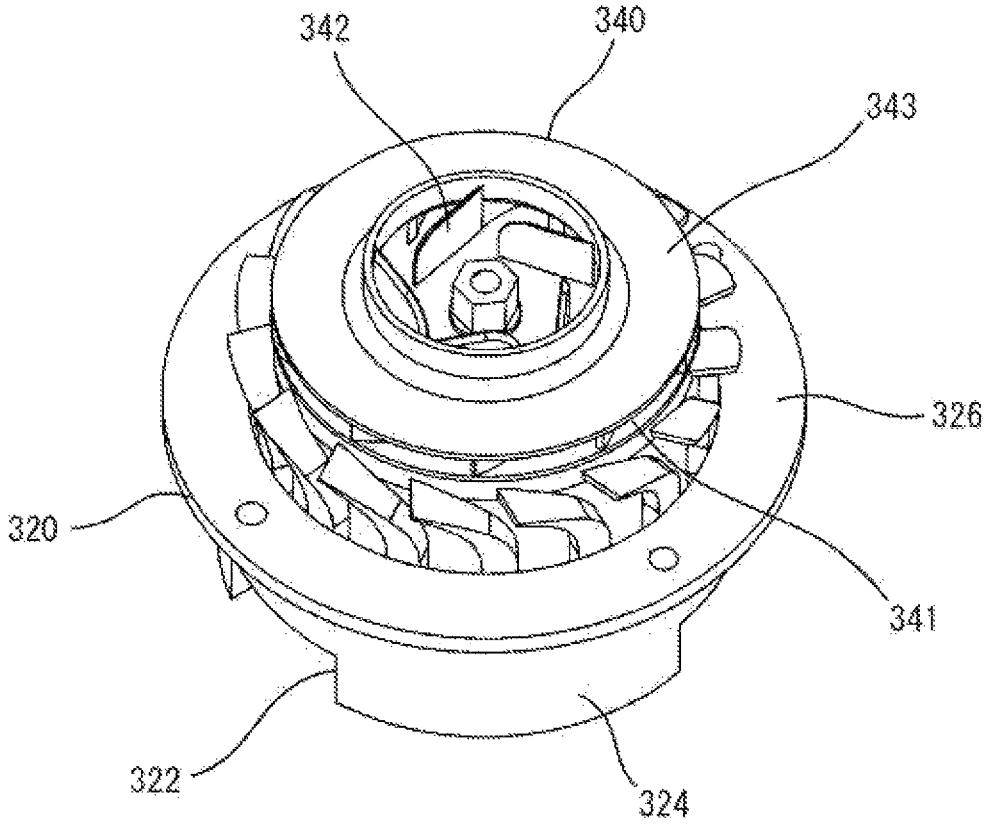
FIG. 19 is a perspective view of the blower apparatus according to the third modification with an impeller cover portion removed therefrom.
Figure 20:
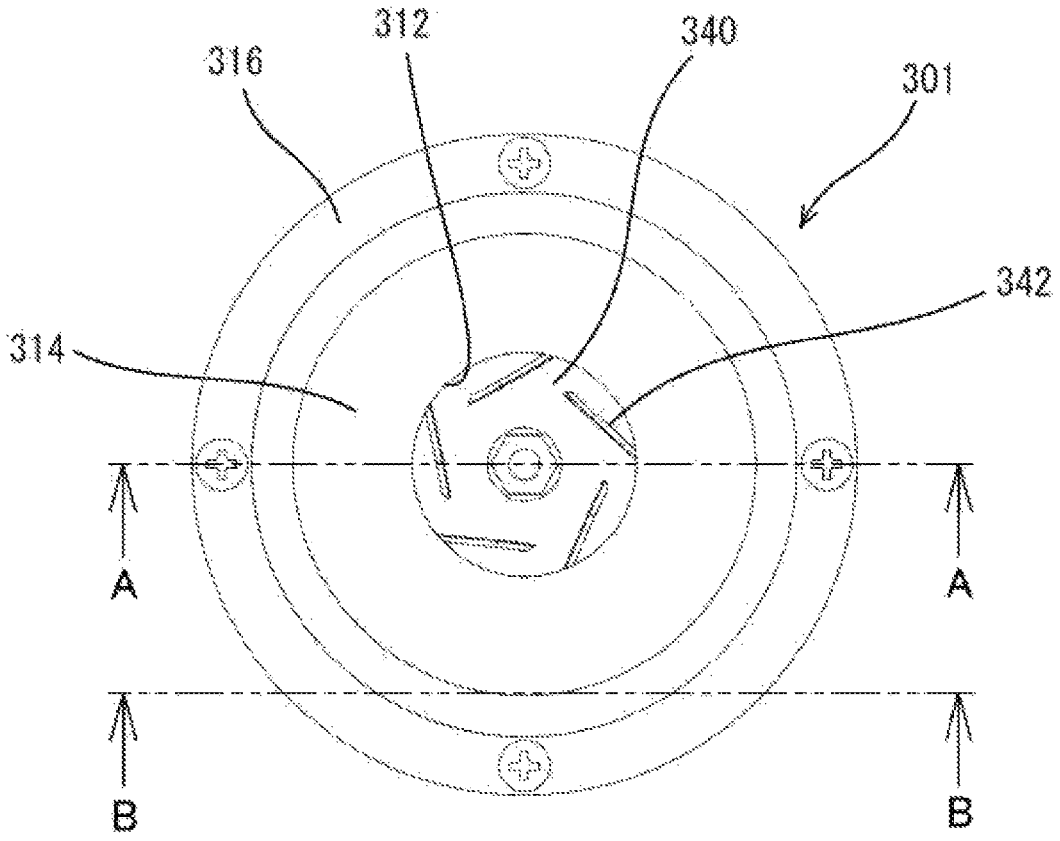
FIG. 20 is a plan view of the blower apparatus according to the third modification.
Figure 21:
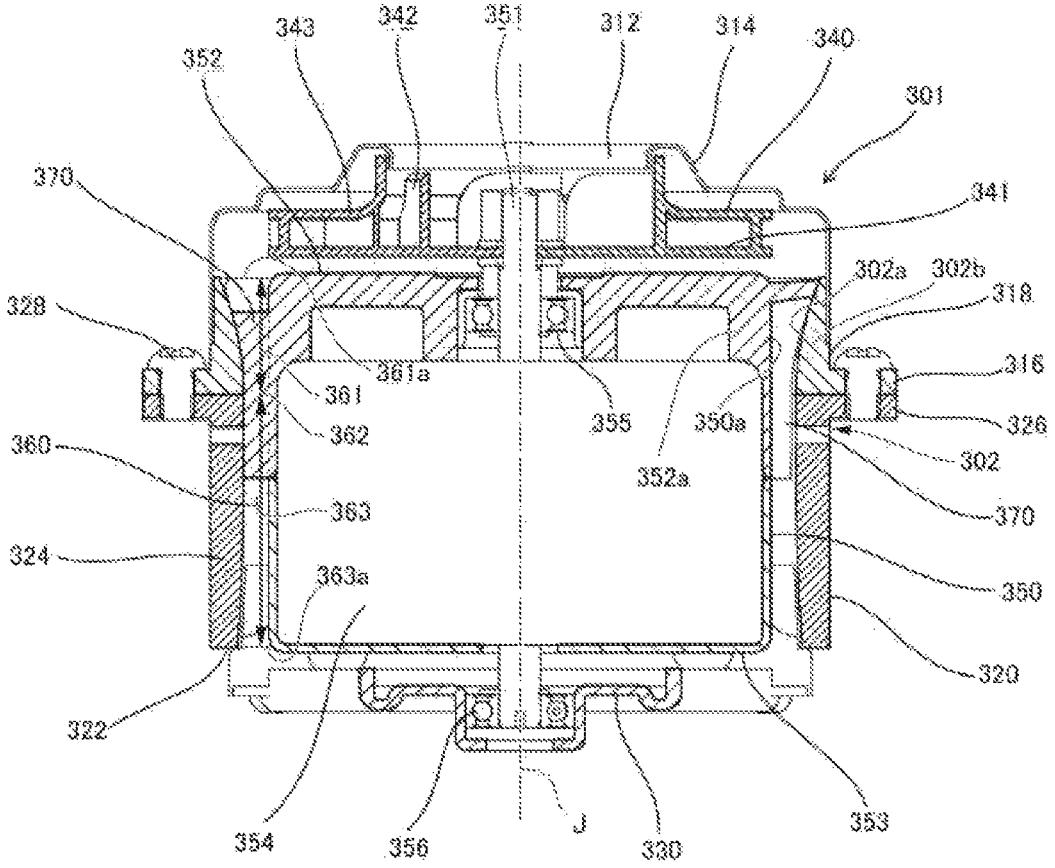
FIG. 21 is a sectional view thereof taken along line A-A in FIG. 20.

FIG. 19 is a perspective view of the blower apparatus 301 illustrated in FIG. 18 with the impeller cover portion 314 removed therefrom. FIG. 20 is a plan view of the blower apparatus 301, and FIG. 21 is a vertical sectional view of the blower apparatus 301 taken along line A-A, which passes through a center of the blower apparatus 301, in FIG. 20. Parallel oblique lines for details of sections of the blower apparatus 301 are omitted.

As illustrated in FIG. 21, an interior space of the blower apparatus 301 is defined by the impeller cover portion 314, the upper cover 318, the lower cover 320, and a bottom cover 330, which is attached to the lower cover 320 to cover a lower surface of the lower cover 320. The blower apparatus 301 further includes an impeller 340, which is defined by a centrifugal impeller, and a motor portion (i.e., a motor) 350, which has a central axis J extending in the vertical direction, in the interior space.

Note that, in the present modification, the motor portion 350 corresponds to the "motor".

The impeller 340 is covered with the impeller cover portion 314. The impeller cover portion 314 includes a cylindrical outer circumferential portion arranged to cover an outer circumference of the impeller 340, and an upper surface portion arranged to cover an upper side of an outer edge portion of the impeller 340. That is, the impeller cover portion 314 includes an inner surface arranged to cover the outer circumference of the impeller 340 and the upper side of the outer edge portion of the impeller 40. In addition, the impeller cover portion 314 includes the air inlet 312, which is defined in a center of the upper surface portion. The impeller 340 includes a base plate (i.e., a base portion) 341, which is defined by a flat circular board, a plurality of rotor blades 342 arranged in a circumferential direction on an upper surface of the base plate 341, and a shroud 343 in the shape of a curved conical surface, including a central opening, and arranged to join upper ends of the rotor blades 342 to one another. An upper end portion of a rotating shaft (i.e., a shaft) 351 of the motor portion 350 is joined to a central portion of the base plate 341. The impeller 340 is thus attached to a rotating portion of the motor portion 350. The central opening of the shroud 343 of the impeller 340 is arranged to be in communication with the air inlet 312 of the impeller cover portion 314.

Note that, in the present modification, the rotating shaft 351 corresponds to the "shaft".

The motor portion 350 is, for example, an inner-rotor brushless motor, and includes a motor housing, which includes an upper housing portion (i.e., a stationary vane support portion) 352 provided with guide vanes (i.e., stationary vanes) 370 and a lower housing portion 353, and motor components 354, which include a rotor portion and a stator portion, accommodated in the motor housing. The rotor portion, which is included in the motor components 354, is supported by the rotating shaft 351, while the rotating shaft 351 is rotatably supported by an upper bearing (i.e., a bearing) 355 held on a central portion of the upper housing portion 352 and a lower bearing (i.e., a bearing) 356 held on a central portion of the bottom cover 330. Once the motor portion 350 is driven, the rotating shaft 351 is caused to rotate together with the rotor portion, which is included in the motor components 354, so that the impeller 340, which is joined to the rotating shaft 351, is also caused to rotate. Rotation of each of the rotor blades 342 of the impeller 340 pushes air in the vicinity of the rotor blade 42 radially outward, generating negative pressure near a radially inner portion of the rotor blade 342, so that external air is sucked in through the air inlet 312. The impeller 340 is caused by the motor portion 350 to rotate in, for example, a counter-clockwise direction in a plan view. That is, the impeller 340 is arranged above the motor portion 350, is joined to the rotating portion of the motor portion 350, and is arranged to rotate to send gas from above radially outward.

Note that, in the present modification, the upper housing portion 352 corresponds to the "stationary vane support portion", and the guide vanes 370 correspond to the "stationary vanes".

The body cover portion 302, which is arranged to cover an outer circumference of the motor portion 350, is defined by the upper cover 318 and the lower cover 320. That is, the body cover portion 302 includes the upper cover 318 and the lower cover 320. In addition, the body cover portion 302 is joined to the impeller cover portion 314 at the upper cover 318. The body cover portion 302 is arranged to cover an outer circumferential surface 350*a* of the motor portion 350. A tubular space 360 is defined between an inner circumferential surface 302*a* of the body cover portion 302 and the outer circumferential surface 350*a* of the motor portion 350. That is, the body cover portion 302 defines the tubular space 360 between the motor portion 350 and the body cover portion 302. The outer circumferential surface 350*a* of the motor portion 350 is arranged to extend in a straight line in the vertical direction. Meanwhile, the inner circumferential surface 302*a* of the body cover portion 302 is arranged to curve while extending in the vertical direction such that the inner circumferential surface 302*a* becomes closest to the central axis J at a middle portion thereof, being convex radially inwardly. That is, the radial distance between the inner circumferential surface 302*a* of the body cover portion 302 and the central axis J varies continuously. Thus, the tubular space 360 is arranged to vary the width of a radial gap therein as the tubular space 360 extends from the upper side to the lower side through a middle portion thereof.

The tubular space 360 defines a channel for air discharged from the impeller 340. In the present modification, the channel for the air is defined only radially outside of the motor portion 350. Therefore, the air discharged from the impeller 340 does not flow radially inside of the outer circumferential surface 350*a* of the motor portion 350.

An upper portion of the tubular space 360 is in communication with a space radially outside of the impeller 340 inside the impeller cover portion 314. Each of the air outlets 322 of the lower cover 320 faces a lower portion of the tubular space 360. An inner circumferential surface of the upper cover 318 is defined as a curved surface whose diameter increases with increasing height, while an inner circumferential surface of the lower cover 320 is substantially cylindrical from an upper portion to a middle portion thereof, but is curved at a lower portion thereof, slightly increasing in diameter with decreasing height. As a result, the radial gap in the tubular space 360 is widest at a top thereof, gradually decreases in width toward a middle portion thereof, and then gradually increases in width from the middle portion toward a bottom thereof. Note that a position at which the radial gap in the tubular space 360 is narrow corresponds to, for example, a boundary between a curved portion and a straight portion of each of the guide vanes, which will be described below.

The structure of the tubular space 360 will now be described more specifically below.

The tubular space 360 includes an upper region 361 and a lower region 363 arranged below the upper region 361. The upper region 361 and the lower region 363 are arranged one above the other in the vertical direction, and the lower region 363 is arranged below the upper region 361. An upper end of the tubular space 360 coincides with an upper end 361*a* of the upper region 361. In addition, a lower end of the tubular space 360 coincides with a lower end 363*a* of the lower region 363.

Here, the upper end of the tubular space 360 means an imaginary surface at an axially upper end of the tubular space 360, and corresponds to an upper opening of the channel. Similarly, the lower end of the tubular space 360 means an imaginary surface at an axially lower end of the tubular space 360, and corresponds to a lower opening of the channel.

In the upper region 361, the radial distance between the outer circumferential surface 350*a* of the motor portion 350 and the inner circumferential surface 302*a* of the body cover portion 302 is arranged to continuously decrease with decreasing height. Meanwhile, in the lower region 363, the radial distance between the outer circumferential surface 350*a* of the motor portion 350 and the inner circumferential surface 302*a* of the body cover portion 302 is arranged to continuously increase with decreasing height.

Because the tubular space 360 includes the upper region 361 and the lower region 363 as described above, the radial gap in the tubular space 360 is narrowest at a boundary portion 362 between the upper region 361 and the lower region 363. Air which has flowed into the tubular space 360 is compressed in the upper region 361 due to an increase in channel resistance, and then flows into the lower region 363. As the air which has flowed into the lower region 363 travels downward, the radial gap gradually increases in width. Accordingly, the air is gradually decompressed, so that the flow becomes gradually gentler, and the air is discharged without a separation, resulting in improved air blowing efficiency. In addition, the tubular space 360 as described above contributes to reducing noise because of the improved air blowing efficiency.

In the present modification, the upper region 361 and the lower region 363 are adjacent to each other in the vertical direction. That is, a lower end of the upper region 361 coincides with an upper end of the lower region 363, and defines the boundary portion 362. Note, however, that an intermediate region may alternatively be arranged between the upper region 361 and the lower region 363. In this case, the radial distance between the motor portion 350 and the body cover portion 302 is preferably arranged to be constant in the intermediate region.

The radial distance between the outer circumferential surface 350*a* of the motor portion 350 and the inner circumferential surface 302*a* of the body cover portion 302 is preferably arranged to be greater at the upper end 361*a* of the upper region 361 than at the lower end 363*a* of the lower region 363. That is, the radial gap in the tubular space 360 is preferably arranged to have the greatest width at the upper end 361*a* of the upper region 361. Exhaust air passing the upper end 361*a* of the upper region 361 may include a component directed radially outward. Accordingly, the radial distance is arranged to be greatest at the upper end 61*a* of the upper region 361 so that the exhaust air can be efficiently guided into the tubular space 360 while the direction of flow of the exhaust air is shifted from a radially outward direction toward a downward direction as the exhaust air travels along an inner circumferential surface of the impeller cover portion 314. Meanwhile, an excessively large radial distance between the motor portion 350 and the body cover portion 302 at the lower end 363*a* of the lower region 363 might easily cause turbulence, resulting in reduced air exhaust efficiency. Therefore, the radial distance between the motor portion 350 and the body cover portion 302 is preferably arranged to be greater at the upper end 361*a* than at the lower end 363*a*.

The body cover portion 302 includes the upper cover 318 and the lower cover 320 divided from each other in the vertical direction. A boundary between the upper cover 318 and the lower cover 320 coincides with the boundary portion 362 between the upper region 361 and the lower region 363. That is, the body cover portion 302 is divided into upper and lower portions at a position at which the radial distance between the outer circumferential surface 350*a* of the motor portion 350 and the inner circumferential surface 302*a* of the body cover portion 302 is smallest in the tubular space 360. Accordingly, the upper cover 318 gradually increases in inside diameter with increasing height from a lower end of the inner circumferential surface 302*a*. Therefore, the upper cover 318 can be easily molded using a mold. Similarly, the lower cover 320 gradually increases in inside diameter with decreasing height from an upper end thereof, and can be easily molded using a mold. Because the body cover portion 302 is divided into the upper and lower portions at the boundary portion 362 as described above, the body cover portion 302 can be easily produced, resulting in a reduced production cost thereof.

Note that, although the body cover portion 302 includes two members (i.e., the upper cover 318 and the lower cover 320) which are divided in the vertical direction in the present modification, the body cover portion 302 may alternatively be defined by a single monolithic member.

Figure 24:
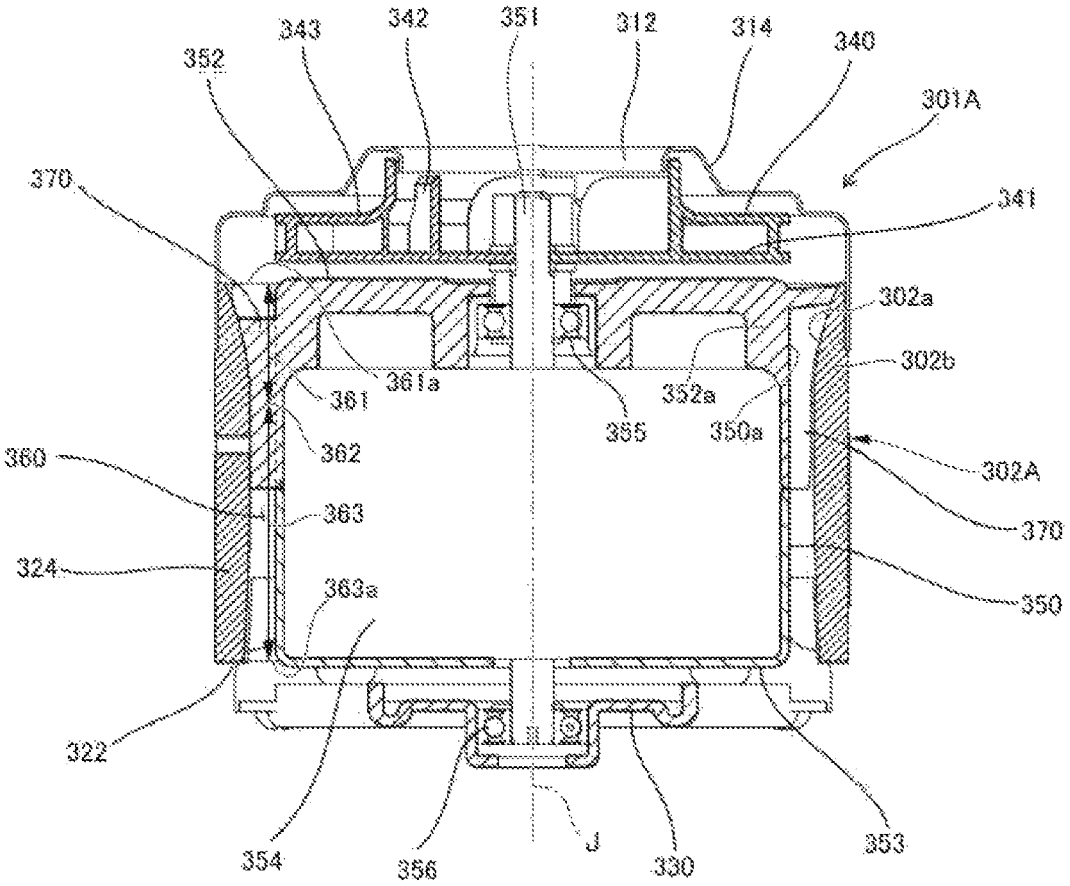
FIG. 24 is a sectional view of the blower apparatus according to the third modification taken along line A-A in FIG. 20, with a body cover portion thereof being alternatively defined by a single monolithic member.

FIG. 24 is a sectional view of a blower apparatus 301A including a body cover portion 302A defined by a single monolithic member. In this case, the body cover portion 302A is defined by a single member which continuously extends in the vertical direction in an inner circumferential surface 302*a*, which defines a tubular space 360. Therefore, the inner circumferential surface 302*a* is a single continuous surface. Accordingly, a joint between members is not exposed in a channel for an air flow passing through the tubular space 360, and the likelihood of a separation of air is reduced, resulting in improved air blowing efficiency. Note that the body cover portion 302A defined by a single monolithic member is molded using a pair of molds which are separated from each other in the vertical direction at a parting line extending along a boundary portion 362.

The guide vanes 370 are arranged at regular intervals in the circumferential direction in the tubular space 360. This allows the air flow to be efficiently guided along a surface of each guide vane 370 without a separation of the air flow. The guide vanes 370 are integrally molded with the upper housing portion 352, and each guide vane 370 includes a curved portion (i.e., a guide vane upper portion) 371 arranged in an upper portion thereof, and a straight portion (i.e., a guide vane lower portion) 372 continuous with the curved portion 71 and arranged to extend axially downward therefrom. That is, each of the guide vanes 370 includes the guide vane upper portion and the guide vane lower portion. The guide vane upper portion is inclined to a greater degree with respect to the axial direction than the straight portion 372. The curved portion 371 of each guide vane 370 is curved in a direction opposite to a rotation direction of the impeller 340 with increasing height. That is, rotation of the impeller 340 generates an air flow whirling in the same direction as the rotation direction of the impeller 340, and the curved shape of the curved portion 371 is defined so that the above air flow can be smoothly taken in and guided into a downward flow, and an air channel is defined so as to guide the whirling air flow sent from the impeller 340 downward.

Figure 22:
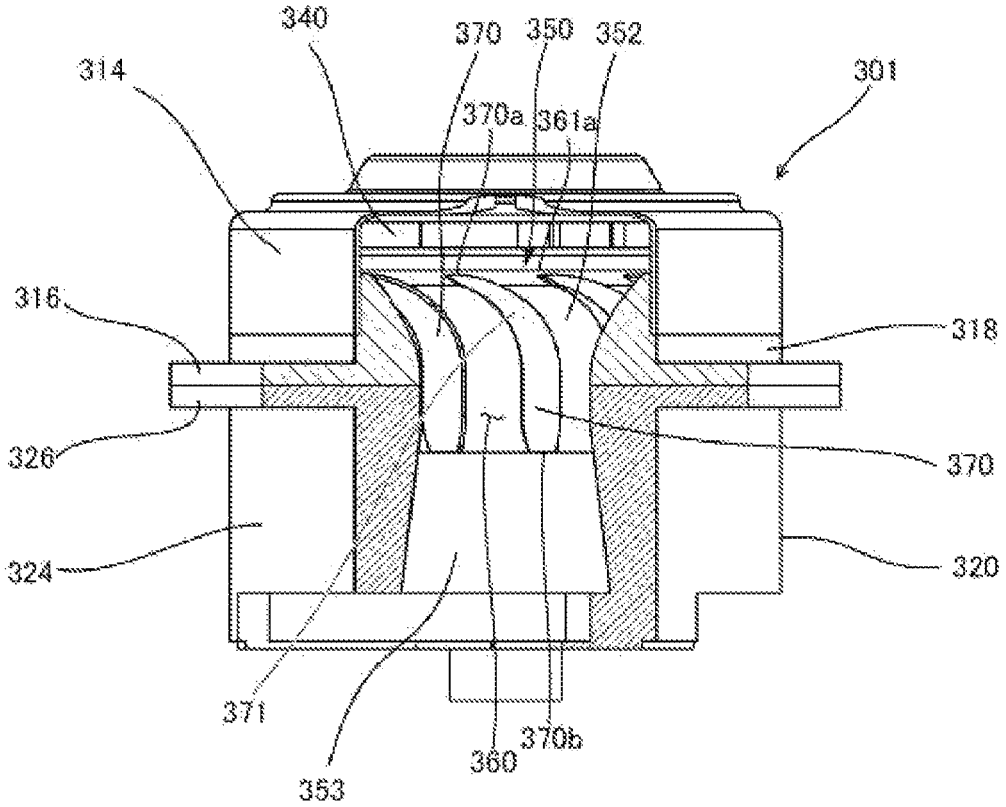
FIG. 22 is a sectional view thereof taken along line B-B in FIG. 20.
Figure 23:
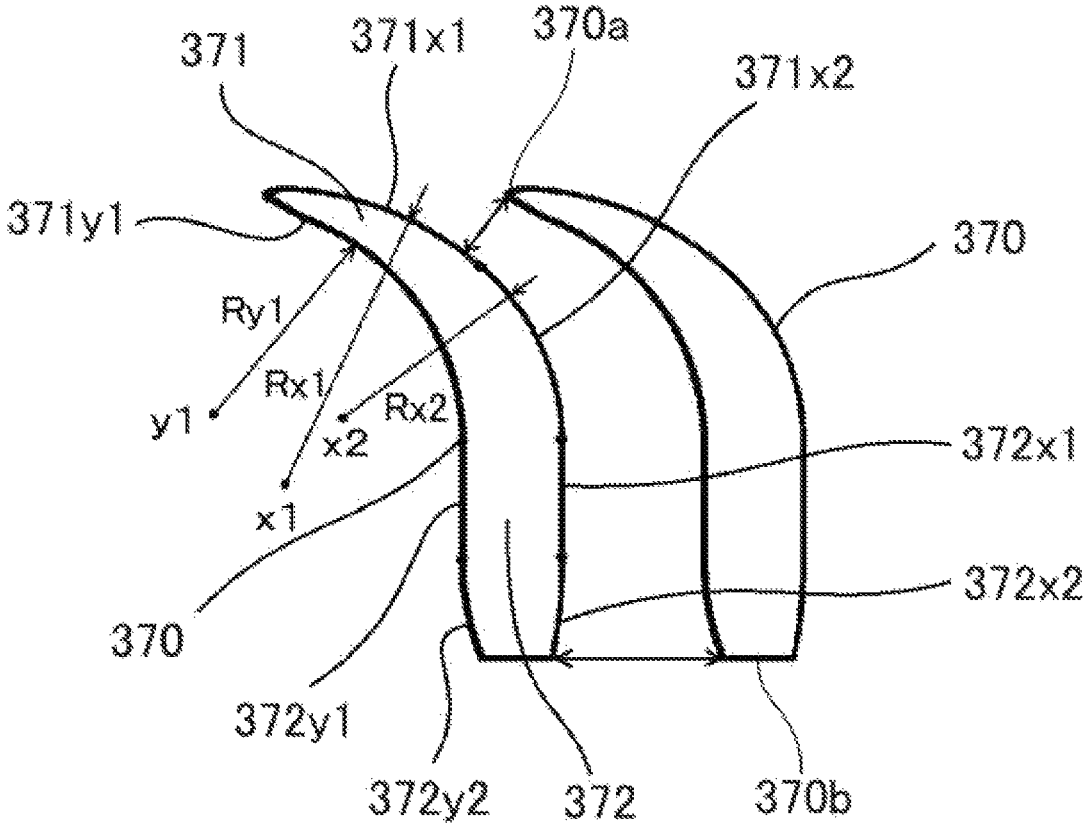
FIG. 23 is a diagram for explaining guide vanes according to the third modification.

To explain more specifically, FIG. 22 illustrates the blower apparatus 301 when the impeller cover portion 314 and the body cover portion 302 are cut along line B-B in FIG. 20, and FIG. 23 illustrates some of the guide vanes 370 illustrated in FIG. 22 in an enlarged form. As illustrated in FIG. 23, two curved surfaces 371*x*1 and 371*x*2 which have different radii of curvature are continuously defined on the downstream side of the curved portion 371 of each guide vane 370 with respect to the rotation direction of the impeller 340, and a radius of curvature Rx1 of the curved surface 371*x*1 on the upper side is greater than a radius of curvature Rx2 of the curved surface 371*x*2 on the lower side (Rx1>Rx2). In addition, on the upstream side of the curved portion 371 of each guide vane 370 with respect to the rotation direction of the impeller 340, a curved surface 371*y*1 having a radius of curvature Ry1 smaller than that of the curved surface 371*x*1 is defined (Rx1>Ry1). A center y1 of the curved surface 371*y*1 is located upstream of a center x1 of the curved surface 371*x*1 and a center x2 of the curved surface 371*x*2 with respect to the rotation direction of the impeller 340.

On the downstream side of the straight portion 372 of each guide vane 370 with respect to the rotation direction of the impeller 340 are defined a flat surface 372*x*1 continuous with the curved surface 371*x*2, and a slanting surface 372*x*2 arranged below the flat surface 372*x*1 and arranged to slant toward the upstream side with respect to the rotation direction with decreasing height. Meanwhile, on the upstream side of the straight portion 372 with respect to the rotation direction are defined a flat surface 372*y*1 continuous with the curved surface 371*y*1, and a slanting surface 372*y*2 arranged below the flat surface 372*y*1 and arranged to slant toward the downstream side with respect to the rotation direction with decreasing height.

Each of the guide vanes 370 is arranged to axially overlap in part with an adjacent one of the guide vanes 370. Specifically, as illustrated in FIG. 22, a tip portion of the curved portion 371 of each guide vane 370 is arranged to axially overlap with both the curved portion 371 and the straight portion 372 of an adjacent one of the guide vanes 370 which is arranged upstream thereof with respect to the rotation direction of the impeller 340. The above structure allows the air sent from the impeller 340 to be more efficiently taken in and guided into the downward flow.

A lower end 370*b* of each guide vane 370 is arranged downstream of an upper end 370*a* of the guide vane 370 with respect to the rotation direction of the impeller 340. The guide vanes 370 are thus able to guide a wind flowing along the rotation direction of the impeller 340 smoothly axially downward, and are able to improve the air blowing efficiency. Note that circumferential positions of the upper end 370*a* and the lower end 370*b* may be compared with each other at a radially outer end of each guide vane 370 to determine which of the upper end 370*a* and the lower end 370*b* of the guide vane 370 lies downstream of the other with respect to the rotation direction. Here, it is preferable that the lower end 370*b* is arranged downstream of the upper end 370*a* with respect to the rotation direction of the impeller 340. For example, also in a case where the guide vane 370 is inclined with respect to the radial direction when viewed from axially above, and in a case where an upper surface of the guide vane 370 is inclined with respect to a direction perpendicular to the axial direction when viewed in the radial direction, the circumferential positions of the upper end 370*a* and the lower end 370*b* may be compared with each other at the radially outer end of the guide vane 370.

As illustrated in FIG. 22, the axial position of the upper end 370*a* of each guide vane 370 coincides with the axial position of an upper end of the motor portion 350. The upper end of the motor portion 350 coincides with the upper end of the tubular space 360 (i.e., the upper end 361*a* of the upper region 361). As described above, the upper end 361*a* of the upper region 361 is a position at which the radial gap in the tubular space 360 is arranged to have the greatest width. Arranging the upper end 370*a* of each guide vane 370 at the position at which the radial gap in the tubular space 360 has the greatest width contributes to reducing the likelihood that turbulence will occur in the air flow, and improving the air blowing efficiency.

An intervane space between every adjacent ones of the guide vanes 370, which are arranged at regular intervals in the circumferential direction in the tubular space 360, is arranged to be narrowest at a tip of the curved portion 371 of the guide vane 370 and widest at a lower end of the straight portion 372 of the guide vane 370 when measured in a direction perpendicular to a direction in which the gas flows in the air channel between the adjacent guide vanes 370.

Once the motor portion 350 is driven in the blower apparatus 301 having the above-described structure, the impeller 340 is caused to rotate to take in external air through the air inlet 312 of the impeller cover portion 314 and discharge the air radially outward as a swirl flow, so that the air is guided to an inner surface of the cylindrical outer circumferential portion of the impeller cover portion 314. Further, the air flow discharged from the impeller 340 is guided into the tubular space 360 to pass through the gap between the adjacent guide vanes 370, so that the swirl flow is guided into an axial flow.

At this time, each guide vane 370 is able to effectively take the swirl flow from the impeller 340 into the gap between the guide vanes 370 through the curved portion 371 arranged in the upper portion thereof. Further, the thickness of the curved portion 371 is arranged to vary along the direction in which the air flows, that is, the curved portion 371 is arranged to have a sophisticated shape with the two curved surfaces 371*x*1 and 371*x*2, which have different radii of curvature, being defined on the downstream side of the guide vane 370 with respect to the rotation direction, and the one curved surface 371*y*1 being defined on the upstream side of the curved portion 371 with respect to the rotation direction, and this contributes to reducing the likelihood of a separation of the air flow, allowing the air flow to be efficiently guided along the surface of the guide vane 370. In particular, when the radii of curvature Rx1 and Rx2 of, respectively, the two curved surfaces 371*x*1 and 371*x*2 on the downstream side of the curved portion 371 with respect to the rotation direction meet the relationship Rx1>Rx2, and the radius of curvature Ry1 of the curved surface 371*y*1 on the upstream side of the curved portion 371 with respect to the rotation direction meets the relationship Rx1>Ry1, the flow in the tubular space 360 is improved to achieve a significant improvement in efficiency.

A boundary between the curved portion 371 and the straight portion 372 is arranged in the vicinity of the position at which the radial distance between the outer circumferential surface 350*a* of the motor portion 350 and the inner circumferential surface 302*a* of the body cover portion 302 is smallest in the tubular space 360 (i.e., the boundary portion 362 in the present modification). Because the radial gap in the tubular space 360 is narrowest in the vicinity of the boundary between the curved portion 371 and the straight portion 372 of each guide vane 370, air which has flowed into the tubular space 360 is compressed in the vicinity of the boundary between the curved portion 371 and the straight portion 372 due to an increase in channel resistance, and the air is thereafter decompressed to form a gentle air flow due to a gradual increase in the width of the radial gap as the air travels downward along the straight portion 372, completing discharge of the air without an occurrence of a separation of the air. In particular, the above effect is promoted by a gradual increase in the width of the gap between the adjacent guide vanes 370 at a lower portion of the straight portion 372.

The upper housing portion 352, which defines a portion of the tubular space 360, includes a cylindrical first ring 352*a*. In addition, the body cover portion 302, which defines a portion of the tubular space 360, includes a cylindrical second ring 302*b*. That is, the tubular space 360, which is cylindrical, is defined between the first ring 352*a* and the second ring 302*b*. In addition, the radial distance between an outer circumferential surface of the first ring 352*a* and an inner circumferential surface of the second ring 302*b* is arranged to continuously decrease with decreasing height in the upper region 361, and continuously increase with decreasing height in the lower region 363. This causes compression of the air and an increase in static pressure in the tubular space 360, and the likelihood of an occurrence of a separation of a wind from an inner wall of the channel is reduced, resulting in improved air blowing efficiency. The first ring 352*a* is arranged radially inside of the guide vanes 370. The second ring 302*b* is arranged radially outside of the guide vanes 370. The first ring 352*a* and the upper housing portion (i.e., a housing) 352 are defined by a single monolithic member. This contributes to increasing coaxiality of the first ring 352*a* with the central axis J, and thus increasing stability of pressure in the channel radially outside of the first ring 352*a*.

Note that not only the first ring 352*a* and the upper housing portion 352 but the first ring 352, the upper housing portion 352, and the lower housing portion 353 may alternatively be defined by a single monolithic member. In this case, the coaxiality of the first ring 352*a* with the central axis J will be further increased, resulting in further increased stability of the pressure.

In the present modification, which has been described by way of example, the first ring 352*a* and the second ring 302*b* are defined by separate members. Note, however, that the first ring 352*a*, the second ring 302*b*, and the guide vanes 370 may alternatively be defined by a single monolithic member. In this case, coaxiality of the tubular space 360 with the motor portion 350 can be improved to make the channel more precisely symmetric with respect to the central axis J of the motor portion 350, which will result in increased stability of the pressure in the channel.

Note that, in the present modification, the guide vanes 370 correspond to the "stationary vanes".

While the present modification has been described above, it will be understood that the present invention is not limited to this modification, and that a variety of modifications are possible without departing from the scope of the present invention as claimed below.

In the present modification, each of the guide vanes 370 arranged in the tubular space 360 is arranged to axially overlap in part with an adjacent one of the guide vanes 370. Note, however, that each of the guide vanes 370 may not necessarily be arranged to axially overlap with an adjacent one of the guide vanes 370. When the guide vanes 370 do not axially overlap with one another, the structure of a resin molding mold for the guide vanes 370 can be simplified. Meanwhile, in the case where the guide vanes 370 are arranged to axially overlap in part with one another, it may be so arranged that alternate ones of the guide vanes 370 are integrally molded with the upper housing portion 352 while the other alternate ones of the guide vanes 370 are integrally molded with the upper cover 318.

Further, although, in the above-described modification, the straight portion 372 of each of the guide vanes 370 arranged in the tubular space 360 is arranged to extend axially downward, this is not essential to the present invention. The straight portion 372 may be arranged to extend downward and be angled with respect to the axial direction toward the direction in which the curved portion 371 is curved. When each guide vane 370 is shaped in such a manner, an effect similar to the effect of the above-described modification can be obtained even if the length of the curved portion 371 is reduced, and therefore, the length of each guide vane 370 can be reduced to achieve a reduction in the size of the apparatus as a whole.

Although, in the above-described modification, the impeller caused by the motor portion 350 to rotate is a centrifugal impeller, this is not essential to the present invention. A mixed flow impeller may alternatively be used. Also in this case, the impeller is joined to the rotating portion of the motor portion, and is caused by the motor portion to rotate to suck air from above and send the gas radially outward while guiding the air along slanting surfaces of the impeller.

<Fourth Modification>

Next, a blower apparatus 401 according to a fourth modification will now be described below with reference to FIG. 25. Note that members or portions that have their equivalents in the above-described modification are denoted by the same reference numerals as those of their equivalents in the above-described modification, and descriptions of those members or portions are omitted.

Figure 25:
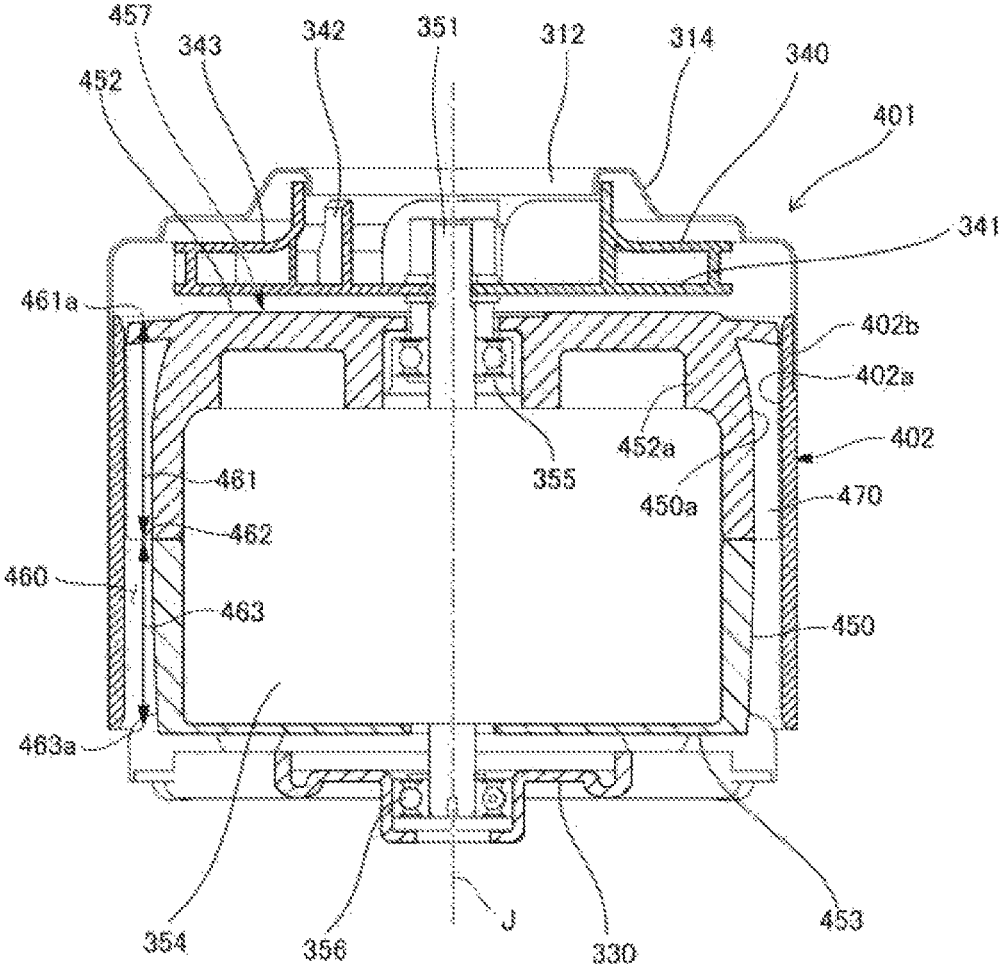
FIG. 25 is a sectional view of a blower apparatus according to a fourth modification of the above embodiment of the present invention.

FIG. 25 is a sectional view of the blower apparatus 401, and corresponds to FIG. 21 of the above-described modification. The blower apparatus 401 is different from the blower apparatus 301 according to the above-described modification in the structures of a body cover portion 402 and a motor housing 457 (i.e., an upper housing portion (i.e., a stationary vane support portion) 452 and a lower housing portion 453) of a motor portion 450.

The body cover portion 402 is arranged to cover an outer circumferential surface 450*a* of the motor portion 450. The body cover portion 402 is joined to an impeller cover portion 314 at an upper end thereof. An inner circumferential surface 402*a* of the body cover portion 402 is arranged to extend in a straight line in the vertical direction.

The motor portion 450 includes the motor housing 457, which includes the upper housing portion 452 and the lower housing portion 453, and motor components 354 accommodated in the motor housing 457. That is, the motor portion 450 includes a housing portion including an outer circumferential surface defining a tubular space 460. The outer circumferential surface 450*a* of the motor portion 450 includes outer circumferential surfaces of the upper housing portion 452 and the lower housing portion 453 continuous with each other. The outer circumferential surface 450*a* of the motor portion 450 is arranged to curve while extending in the vertical direction such that the outer circumferential surface 450*a* becomes most distant from a central axis J at a middle portion thereof, being convex radially outwardly. That is, the radial distance between the outer circumferential surface of the housing portion and the central axis J varies continuously along the tubular space 460. On the outer circumferential surface 450*a* of the motor portion 450, a plurality of guide vanes 470 are arranged at regular intervals in the circumferential direction.

The tubular space 460 is defined between the inner circumferential surface 402*a* of the body cover portion 402 and the outer circumferential surface 450*a* of the motor portion 450. That is, the body cover portion 402 defines the tubular space 460 between the motor portion 450 and the body cover portion 402. The tubular space 460 includes an upper region 461 and a lower region 463 arranged one above the other in the vertical direction. In the upper region 461, the radial distance between the outer circumferential surface 450*a* of the motor portion 450 and the inner circumferential surface 402*a* of the body cover portion 402 (i.e., the width of a radial gap in the tubular space 460) is arranged to continuously decrease with decreasing height. Meanwhile, in the lower region 463, the radial distance between the outer circumferential surface 450*a* of the motor portion 450 and the inner circumferential surface 402*a* of the body cover portion 402 (i.e., the width of the radial gap in the tubular space 460) is arranged to continuously increase with decreasing height. In addition, the radial distance between the outer circumferential surface 450*a* of the motor portion 450 and the inner circumferential surface 402*a* of the body cover portion 402 is arranged to be greater at an upper end 461*a* of the upper region 461 than at a lower end 463*a* of the lower region 463.

Due to the inclusion of the tubular space 460 including the upper region 461 and the lower region 463, which are similar to those of the blower apparatus 301 according to the third modification, the blower apparatus 401 according to the present modification is able to achieve beneficial effects similar to those of the blower apparatus 301. That is, beneficial effects of an improvement in the air blowing efficiency and a reduction in noise can be achieved.

The upper housing portion 452, which defines a portion of the tubular space 460, includes a cylindrical first ring 452*a*. In addition, the body cover portion 402, which defines a portion of the tubular space 460, includes a cylindrical second ring 402*b*. That is, the tubular space 460, which is cylindrical, is defined between the first ring 452*a* and the second ring 402*b*. The first ring 452*a* is arranged radially inside of the guide vanes 470. The second ring 402*b* is arranged radially outside of the guide vanes 470.

In the present modification, which has been described by way of example, the first ring 452*a* and the second ring 402*b* are defined by separate members. Note, however, that the first ring 452*a*, the second ring 402*b*, and the guide vanes 470 may alternatively be defined by a single monolithic member. In this case, coaxiality of the tubular space 460 with the motor portion 450 can be improved to make a channel more precisely symmetric with respect to the central axis J of the motor portion 450, which will result in increased stability of pressure in the channel.

The motor housing 457 includes the upper housing portion 452 and the lower housing portion 453 divided from each other in the vertical direction. A boundary between the upper housing portion 452 and the lower housing portion 453 coincides with a boundary portion 462 between the upper region 461 and the lower region 463. That is, the housing portion is divided into upper and lower portions at a position at which the radial distance between the outer circumferential surface 450*a* of the motor portion 450 and the inner circumferential surface 402*a* of the body cover portion 402 is smallest in the tubular space 460. The motor housing 457 is divided into upper and lower portions at the position at which the radial distance between the outer circumferential surface 450*a* of the motor portion 450 and the inner circumferential surface 402*a* of the body cover portion 402 is smallest in the tubular space 460 (i.e., at the boundary portion 462 in the present modification). Accordingly, the upper housing portion 452 gradually decreases in outside diameter with increasing height from a lower end of the outer circumferential surface 450*a*. Therefore, the upper housing portion 452 can be easily molded using a mold. Similarly, the lower housing portion 453 gradually decreases in outside diameter with decreasing height from an upper end thereof, and can be easily molded using a mold. Because the motor housing 457 is divided into the upper and lower portions at the boundary portion 462 as described above, the motor housing 457 can be easily produced, resulting in a reduced production cost thereof.

Figure 26:
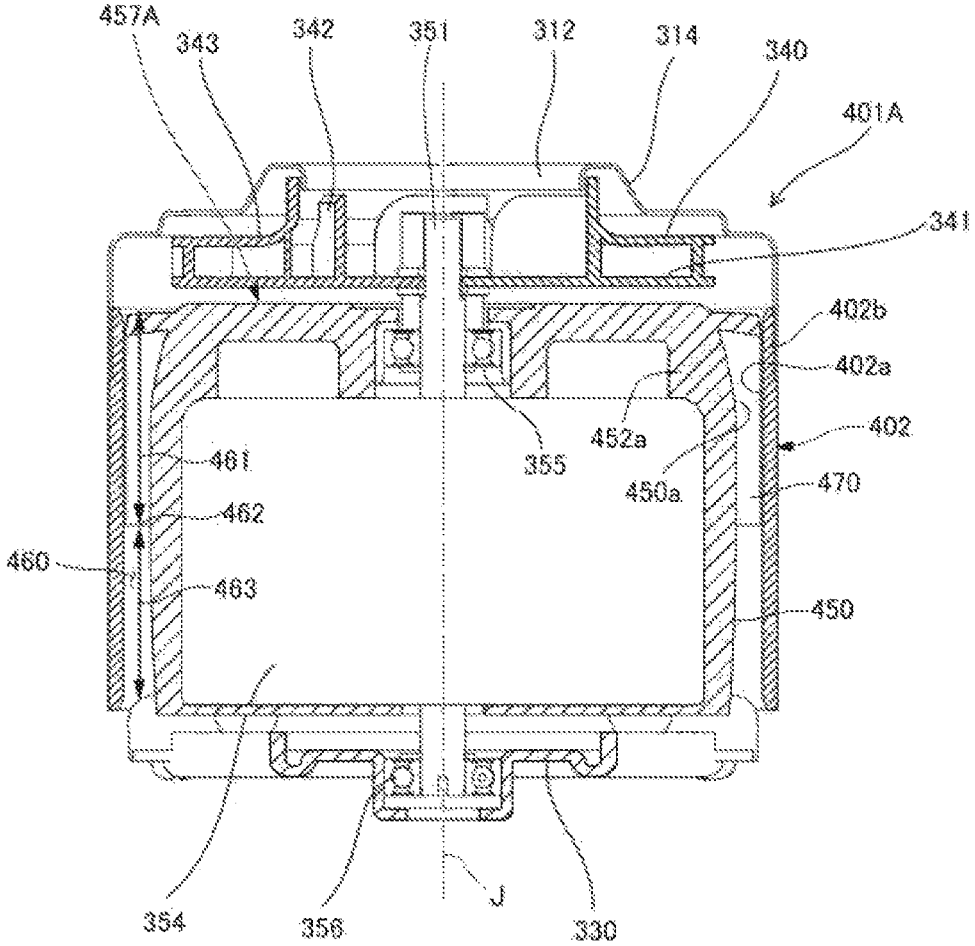
FIG. 26 is a sectional view of the blower apparatus according to the fourth modification, with a motor housing thereof being alternatively defined by a single monolithic member.

Note that the motor housing 457 may alternatively be defined by a single monolithic member. FIG. 26 illustrates a blower apparatus 401A including a motor housing 457A defined by a single monolithic member. A housing portion is defined by a single member which continuously extends in the vertical direction in an outer circumferential surface 450*a*, which defines a tubular space 460, and the outer circumferential surface 450*a* defines a single continuous surface. Accordingly, a joint between members is not exposed in a channel for an air flow passing through the tubular space 460, and the likelihood of a separation of air is reduced, resulting in improved air blowing efficiency. In the case where the housing portion is defined by a single member, a parting line is defined at a position at which the radial distance between the outer circumferential surface 450*a* of a motor portion 450 and an inner circumferential surface 402*a* of a body cover portion 402 is smallest. The motor housing 457A is preferably molded integrally with a stator including a conducting wire wound into a coil buried in the motor housing 457A. The stator can thus be securely held thereby.

Figure 27:
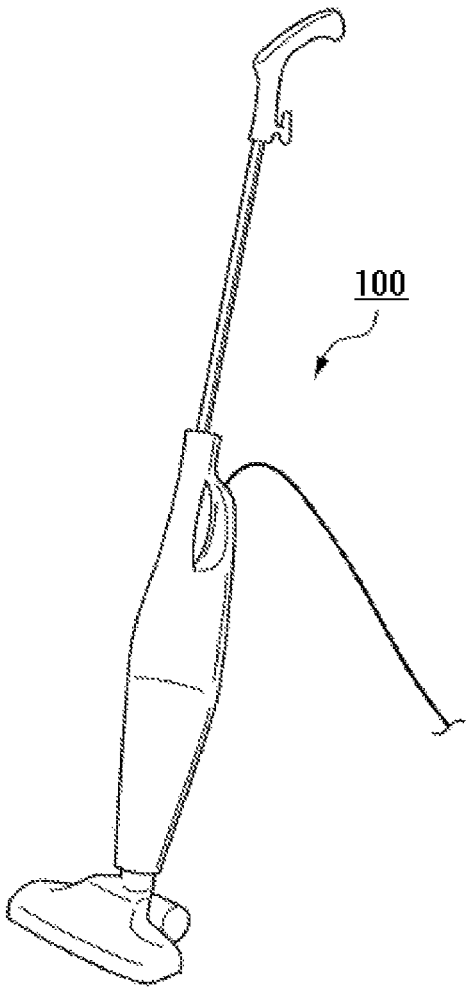
FIG. 27 is a perspective view of a vacuum cleaner including a blower apparatus according to an embodiment of the present invention.

FIG. 27 is a perspective view of a vacuum cleaner 100 including the blower apparatus 301. The vacuum cleaner 100 includes the above-described blower apparatus 301. Accordingly, the radial width of a channel defined in the vacuum cleaner 100 can be made highly uniform, and an improvement in air exhaust efficiency can be achieved.

Although the blower apparatus according to each of the above-described embodiment of the present invention and the modifications thereof is used in a vacuum cleaner which utilizes air sucked by the blower apparatus, this is not essential to the present invention. A blower apparatus according to an embodiment of the present invention may be used in, for example, a hair dryer.

While embodiments of the present invention and modifications thereof have been described above, it will be understood that features, a combination of the features, and so on according to each of the embodiments and the modifications thereof are only illustrative and not restrictive, and that an addition, elimination, and substitution of a feature(s), and other modifications can be made without departing from the scope and spirit of the present invention. Also note that the present invention is not limited by the embodiments.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A blower apparatus comprising:

a motor including a shaft that extends along a central axis extending in a vertical direction, and a bearing that rotatably supports the shaft;

an impeller coupled to the shaft on an upper end side of the shaft;

an impeller housing that houses the impeller, and includes an air inlet on an upper side;

a plurality of stationary vanes on a lower side of the impeller housing;

a cylindrical first ring radially inside of the stationary vanes; and a cylindrical second ring radially outside of the stationary vanes, and fixed to the impeller housing; wherein the stationary vanes, the first ring, and the second ring are defined by a single monolithic member, and together define at least a portion of a stationary vane support portion;

the motor further includes a housing defined by an upper lid, a circumferential wall, and a lower lid; and the stationary vane support portion is directly fixed to an upper surface of the upper lid.

2. The blower apparatus according to claim 1, further comprising a third ring on a lower side of the stationary vanes, wherein the stationary vane support portion includes a first fixing portion to which the third ring is fixed; and the third ring includes a third ring slanting portion having an outer circumference arranged to extend radially outward with decreasing height.

3. The blower apparatus according to claim 2, wherein the third ring further includes a lower stationary vane on the lower side of the stationary vanes.

4. The blower apparatus according to claim 2, wherein the stationary vane support portion includes a second fixing portion fixed to the housing at a position different from that of the first fixing portion.

5. The blower apparatus according to claim 1, wherein the impeller housing includes an impeller housing body portion that covers an upper side of the impeller, an exhaust air guide portion that extends radially outward and downward from an outer circumferential edge of the impeller housing body portion, and an outer circumferential fitting ring that extends upward from an outer circumferential edge of the exhaust air guide portion, and fixed to the second ring; and an upper surface of the impeller housing includes a recessed portion that extends in a circumferential direction on an upper side of the exhaust air guide portion, and is recessed downward.

6. The blower apparatus according to claim 1, wherein the impeller includes a plurality of rotor blades, and a base portion in a shape of a disk and arranged on a lower side of the rotor blades;

the stationary vane support portion includes an annular projecting portion that projects upward, and is radially outside of the impeller;

the projecting portion includes an outer circumferential surface that slants downward as the outer circumferential surface extends radially outward; and an upper end of the projecting portion is at a level higher than that of a lower surface of the base portion and lower than that of an outer end of an upper surface of the base portion.

7. The blower apparatus according to claim 1, wherein the impeller includes a plurality of rotor blades, a base portion in a shape of a disk on a lower side of the rotor blades, and a shroud in a shape of a tapered cylinder that extends radially inward with increasing height on an upper side of the rotor blades;

the base portion includes an outer edge radially outward of an outer edge of the shroud; and an upper surface of the base portion includes a base portion slanting portion that slants axially downward as the base portion slanting portion extends radially outward.

8. A vacuum cleaner comprising the blower apparatus of claim 1.

9. The blower apparatus according to claim 1, wherein the upper lid directly supports the bearing.

10. The blower apparatus according to claim 1, wherein the stationary vane support portion is directly fixed to the upper lid through a fastener extending through both of the stationary vane support portion and the upper lid.

11. A blower apparatus comprising:

a motor including a shaft that extends along a central axis extending in a vertical direction, and a bearing that rotatably supports the shaft;

an impeller coupled to the shaft on an upper end side of the shaft;

an impeller housing that houses the impeller, and includes an air inlet on an upper side;

a plurality of stationary vanes on a lower side of the impeller housing;

a cylindrical first ring radially inside of the stationary vanes; and a cylindrical second ring radially outside of the stationary vanes, and fixed to the impeller housing; wherein the stationary vanes, the first ring, and the second ring are defined by a single monolithic member, and together define at least a portion of a stationary vane support portion;

the first ring and the second ring include a tubular space defined therebetween, the tubular space being cylindrical;

the tubular space includes an upper region and a lower region below the upper region; and a radial distance between an outer circumferential surface of the first ring and an inner circumferential surface of the second ring continuously decreases with decreasing height in the upper region, and continuously increases with decreasing height in the lower region.

12. The blower apparatus according to claim 11, further comprising a third ring on a lower side of the stationary vanes, wherein the stationary vane support portion includes a first fixing portion to which the third ring is fixed; and the third ring includes a third ring slanting portion having an outer circumference arranged to extend radially outward with decreasing height.

13. The blower apparatus according to claim 12, wherein the third ring further includes a lower stationary vane on the lower side of the stationary vanes.

14. The blower apparatus according to claim 12, wherein the stationary vane support portion includes a second fixing portion fixed to the housing at a position different from that of the first fixing portion.

15. The blower apparatus according to claim 11, wherein the impeller housing includes an impeller housing body portion that covers an upper side of the impeller, an exhaust air guide portion that extends radially outward and downward from an outer circumferential edge of the impeller housing body portion, and an outer circumferential fitting ring that extends upward from an outer circumferential edge of the exhaust air guide portion, and fixed to the second ring; and an upper surface of the impeller housing includes a recessed portion that extends in a circumferential direction on an upper side of the exhaust air guide portion, and is recessed downward.

16. The blower apparatus according to claim 11, wherein the impeller includes a plurality of rotor blades, and a base portion in a shape of a disk and arranged on a lower side of the rotor blades;

the stationary vane support portion includes an annular projecting portion that projects upward, and is radially outside of the impeller;

the projecting portion includes an outer circumferential surface that slants downward as the outer circumferential surface extends radially outward; and an upper end of the projecting portion is at a level higher than that of a lower surface of the base portion and lower than that of an outer end of an upper surface of the base portion.

17. The blower apparatus according to claim 11, wherein the impeller includes a plurality of rotor blades, a base portion in a shape of a disk on a lower side of the rotor blades, and a shroud in a shape of a tapered cylinder that extends radially inward with increasing height on an upper side of the rotor blades;

the base portion includes an outer edge radially outward of an outer edge of the shroud; and an upper surface of the base portion includes a base portion slanting portion that slants axially downward as the base portion slanting portion extends radially outward.

18. A vacuum cleaner comprising the blower apparatus of claim 11.

* * * * *